US010032446B2

(12) United States Patent
Kropf

(10) Patent No.: US 10,032,446 B2
(45) Date of Patent: Jul. 24, 2018

(54) UNDERWATER VOICE COMMUNICATION DEVICES AND ASSOCIATED METHODS

(71) Applicant: Keith Kropf, Key Largo, FL (US)

(72) Inventor: Keith Kropf, Key Largo, FL (US)

( * ) Notice: Subject to any disclaimer, the term of this patent is extended or adjusted under 35 U.S.C. 154(b) by 0 days.

(21) Appl. No.: 14/931,751

(22) Filed: Nov. 3, 2015

(65) Prior Publication Data

US 2016/0094912 A1 Mar. 31, 2016

Related U.S. Application Data

(63) Continuation-in-part of application No. 14/868,139, filed on Sep. 28, 2015, now Pat. No. 9,949,022.

(60) Provisional application No. 62/194,130, filed on Jul. 17, 2015, provisional application No. 62/056,736, filed on Sep. 29, 2014.

(51) Int. Cl.
*H04R 1/02* (2006.01)
*G10K 11/22* (2006.01)

(52) U.S. Cl.
CPC ..... *G10K 11/22* (2013.01); *G10K 2200/11* (2013.01)

(58) Field of Classification Search
CPC ..... G10K 11/22; G10K 2200/11
USPC ..... 381/311, 334; 181/21, 22, 110, 18, 120, 181/149; 367/131, 132
See application file for complete search history.

(56) References Cited

U.S. PATENT DOCUMENTS 945,929 A 1/1910 Gager
1,418,388 A 6/1922 Miessner
1,771,774 A * 7/1930 Cox ..... B61D 41/00 181/22
2,844,212 A 7/1958 Hogan et al.
3,123,680 A 3/1964 Minton, Jr. et al.
3,174,129 A 3/1965 Laughlin et al.
3,210,723 A 10/1965 Martelli et al.
3,461,910 A 8/1969 Selsam et al.
3,670,299 A 6/1972 Kahn
3,828,887 A 8/1974 Alexander
(Continued)

FOREIGN PATENT DOCUMENTS

GB 1915 08424 3/1916
JP H08-19079 1/1996
(Continued)

OTHER PUBLICATIONS

Navy, Voicepipes & Speaking Tubes, 2010, p. 1-2.*
(Continued)

*Primary Examiner* — William A Jerez Lora
(74) *Attorney, Agent, or Firm* — Wells St. John P.S.

(57) ABSTRACT

Underwater voice communication devices and associated methods are described. According to one aspect, an underwater voice communication device includes a voice chamber comprising a face seal which is configured to form at least a substantially watertight seal with respect to a mouth of a first user, wherein the voice chamber comprises an internal volume, an earpiece comprising an ear seal which is configured to form at least a substantially watertight seal with respect to an ear of a second user, wherein the earpiece comprises an internal volume which is in fluid communication with the internal volume of the voice chamber, and wherein the internal volumes of the voice chamber and earpiece communicate voice sound waves from the mouth of the first user to the ear of the second user.

28 Claims, 16 Drawing Sheets

(56) References Cited

U.S. PATENT DOCUMENTS

| | | | | |
|---|---|---|---|---|
| 3,993,973 | A | 11/1976 | Hutchins et al. | |
| 4,183,422 | A | 1/1980 | Williams | |
| 4,414,851 | A * | 11/1983 | Maglic | G01L 19/14 361/283.3 |
| 4,485,272 | A | 11/1984 | Duong et al. | |
| 4,527,657 | A * | 7/1985 | Payne | B63C 11/26 128/200.29 |
| 4,763,307 | A | 8/1988 | Massa | |
| 4,839,871 | A | 6/1989 | Massey | |
| 5,825,718 | A | 10/1998 | Ueki et al. | |
| 8,006,320 | B1 * | 8/2011 | Rohbani | A61F 11/14 128/866 |
| 2003/0123692 | A1 | 7/2003 | Ueki | |
| 2004/0182641 | A1 * | 9/2004 | Overmyer | B63C 11/26 181/21 |
| 2006/0140421 | A1 | 6/2006 | Swafford | |
| 2008/0298177 | A1 | 12/2008 | Giles et al. | |
| 2010/0284553 | A1 | 11/2010 | Conti et al. | |
| 2012/0256867 | A1 | 10/2012 | Annacone | |
| 2016/0094911 | A1 | 3/2016 | Kropf | |

FOREIGN PATENT DOCUMENTS

| | | | |
|---|---|---|---|
| JP | 3295680 | * | 6/2002 |
| WO | WO 2012/095780 | | 7/2012 |

OTHER PUBLICATIONS

Techwalla, How to Waterproof Headphones, 2015.*
WO PCT/US2015/052727 Inv Pay Fees, dated Nov. 16, 2015, Kropf.
WO PCT/US2015/052727 IPRP, dated Apr. 4, 2017, Kropf.
WO PCT/US2015/052727 Search Rept., dated Jan. 11, 2016, Kropf.
WO PCT/US2015/052727 Writ. Opin., dated Jan. 11, 2016, Kropf.
WO PCT/US2016/024156 Inv Pay Fees, dated Jun. 2, 2016, Kropf.
WO PCT/US2016/024156 Search Rept., dated Jul. 22, 2016, Keith Kropf.
WO PCT/US2016/024156 Writ. Opin., dated Jul. 22, 2016, Keith Kropf.
Kropf, U.S. Appl. No. 62/056,736, filed Sep. 29, 2014, titled "Underwater Communication Devices and Methods", 25 pages.
Kropf, U.S. Appl. No. 62/194,130, filed Jul. 17, 2015, titled "Underwater Voice Communication Device", 10 pages.
Clerk Synthesis, Inc., "Diluvio™ Underwater Speaker" and brochure, available online at http://clarksynthesis.com/ clark-synthesis-products/diluvio-underwater-speaker/, Sep. 19, 2014, 3 pages.
Coomber Electronic Equipment Ltd., "1932 Underwater Loudspeaker", available online at http://www.coomberaudio.com/equipment/details/Speakers/1932-Underwater-Loudspeaker.html, Oct. 7, 2013, 5 pages.
DiveSCULS, "About SCULS", available online at http://divesculsnet.domain.com:80/about/, May 25, 2014, 2 pages.
DiveSCULS, "SCULS Self Contained Underwater Loud Speaker", available online at http://divesculsnet.domain.com:80/products-page/product-category/sculs/, May 25, 2014, 1 page.
Lubell Labs Inc., "Clark Synthesis AQ339 Aquasonic Underwater Speaker", available online at http://lubell.com/AQ339.html. Sep. 22, 2013, 1 page.
Lubell Labs Inc., "EV UW30 Underwater Speaker for Marine Biology", available online at http://lubell.com/UW30.html, Dec. 12, 2013, 2 pages.
Lubell Labs Inc., "LL916C Underwater Speaker", available online at http://lubell.com/LL916.html, Dec. 3, 2013, 1 page.
Lubell Labs Inc., "LL916H & LL916C Pistonic Piezoelectric Underswater Speakers" available online at http://lubell.com/LL916.html, Feb. 21, 2016, 2 pages.
Ocean Reef Group, "GSM G.DIVERS", available online at http://diving.oceanreefgroup.com/accessory/gsm-g-divers/, Feb. 25, 2017, 2 pages.
Ocean Technology Systems, "Buddy Phone Through-Water Tranceivers (1/2 Watt Output Power)", available online at http://ots.mwrc.net/en/product.php?product_id=44767, Dec. 26, 2015, 4 pages.
Ocean Technology Systems, "EM-OTS2 for Guardian FFM", available online at http://ots.mwrc.net/en/product.php-?product_id=44547, Jun. 23, 2012, 3 pages.
Ocean Technology Systems, "ME-16R Hot Mic (150 Ohm)", available online at http://ots.mwrc.net/en/product.php-?product_id=43905, Apr. 28, 2016, 3 pages.
Oceanears, "Underwater Speaker DRS-8", available online at http://oceanears.com/drs-8-underwater-speaker/, Oct. 25, 2015, 4 pages.
Uetax, "Underwater Speaker UA30, UA40, UA50, UA60", available online at http://uetax.co.jp/hpj/products/en/en-underwater-speaker/, Feb. 25, 2017, 1 page.
Yamagata Casino Co., Ltd., "Logosease", available online at http://logosease.yamagata-casio.co.jp/en/product/, May 10, 2013, 2 pages.
WO PCT/US2016/024156 IPRP, dated Jan. 23, 2018, Keith Kropf.

* cited by examiner

UNDERWATER VOICE COMMUNICATION DEVICES AND ASSOCIATED METHODS

RELATED PATENT DATA

This application claims priority to and the benefit of U.S. Provisional Patent Application Ser. No. 62/194,130 filed Jul. 17, 2015, titled "Underwater Voice Communication Device", and is a continuation-in-part of and also claims priority to U.S. patent application Ser. No. 14/868,139, filed Sep. 28, 2015, titled "Underwater Communication Systems, Underwater Speakers, Underwater Microphone Assemblies and Methods", which claims priority to and the benefit of U.S. Provisional Patent Application Ser. No. 62/056,736 filed Sep. 29, 2014, titled "Underwater Communication Devices and Methods", the disclosures of all of which are incorporated herein by reference.

TECHNICAL FIELD

This disclosure relates to underwater voice communication devices and associated methods, including methods of use to communicate underwater.

BACKGROUND OF THE DISCLOSURE

Communications underwater between people is difficult. Some communications are possible by speaking as long as the words used are short and commonly understood by the underwater listeners. However, generally detailed conversations are not possible and fidelity of any underwater communications is typically poor. In some instances, such as underwater research facilities, a volume of air may be provided below the surface of the water (for example using container which defines a volume of air and is inverted to be open at the bottom). Underwater researchers may surface within the volume to talk with one another without having to surface at the top of the water column or re-enter their underwater research facility.

At least some aspects of the disclosure are directed to underwater voice communication devices and associated methods which facilitate underwater voice communications between two or more people.

BRIEF DESCRIPTION OF THE DRAWINGS

Example embodiments of the disclosure are described below with reference to the following accompanying drawings.

DETAILED DESCRIPTION OF THE DISCLOSURE

Figure 1:
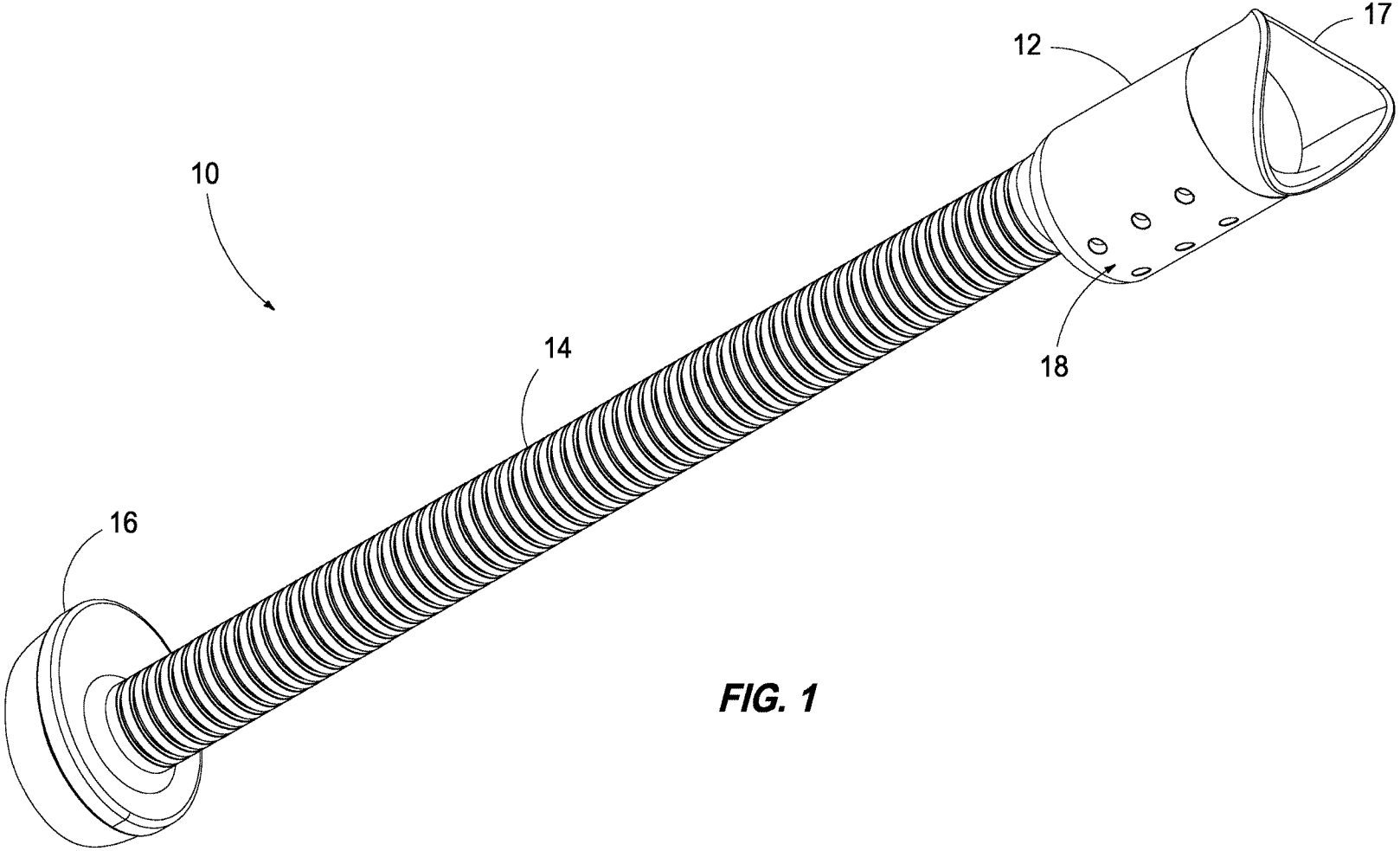
FIG. 1 is a lower isometric view seen from a first end of an underwater voice communication device according to one embodiment.
Figure 2:
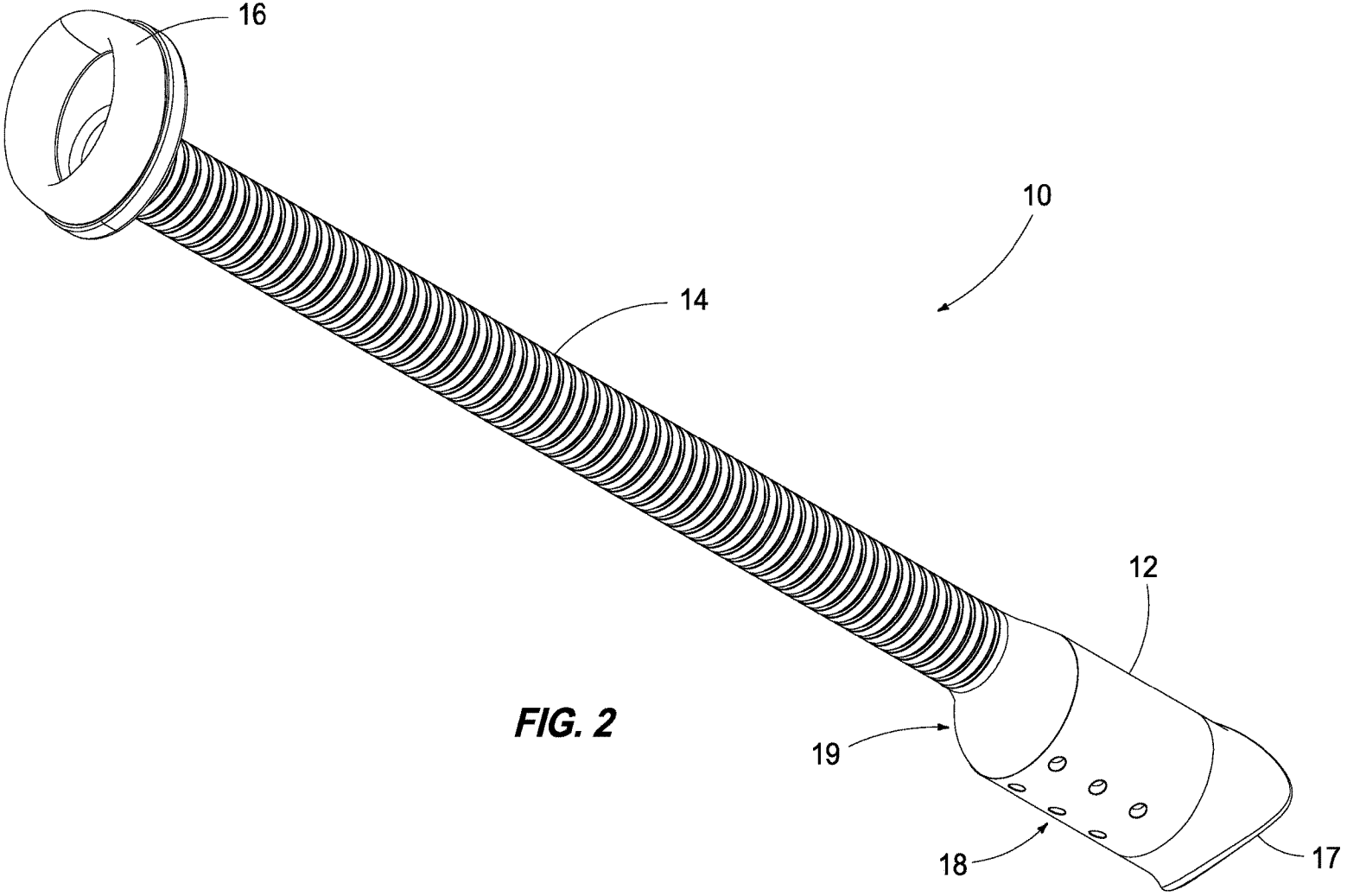
FIG. 2 is a lower isometric view seen from a second end of an underwater voice communication device according to one embodiment.
Figure 3:
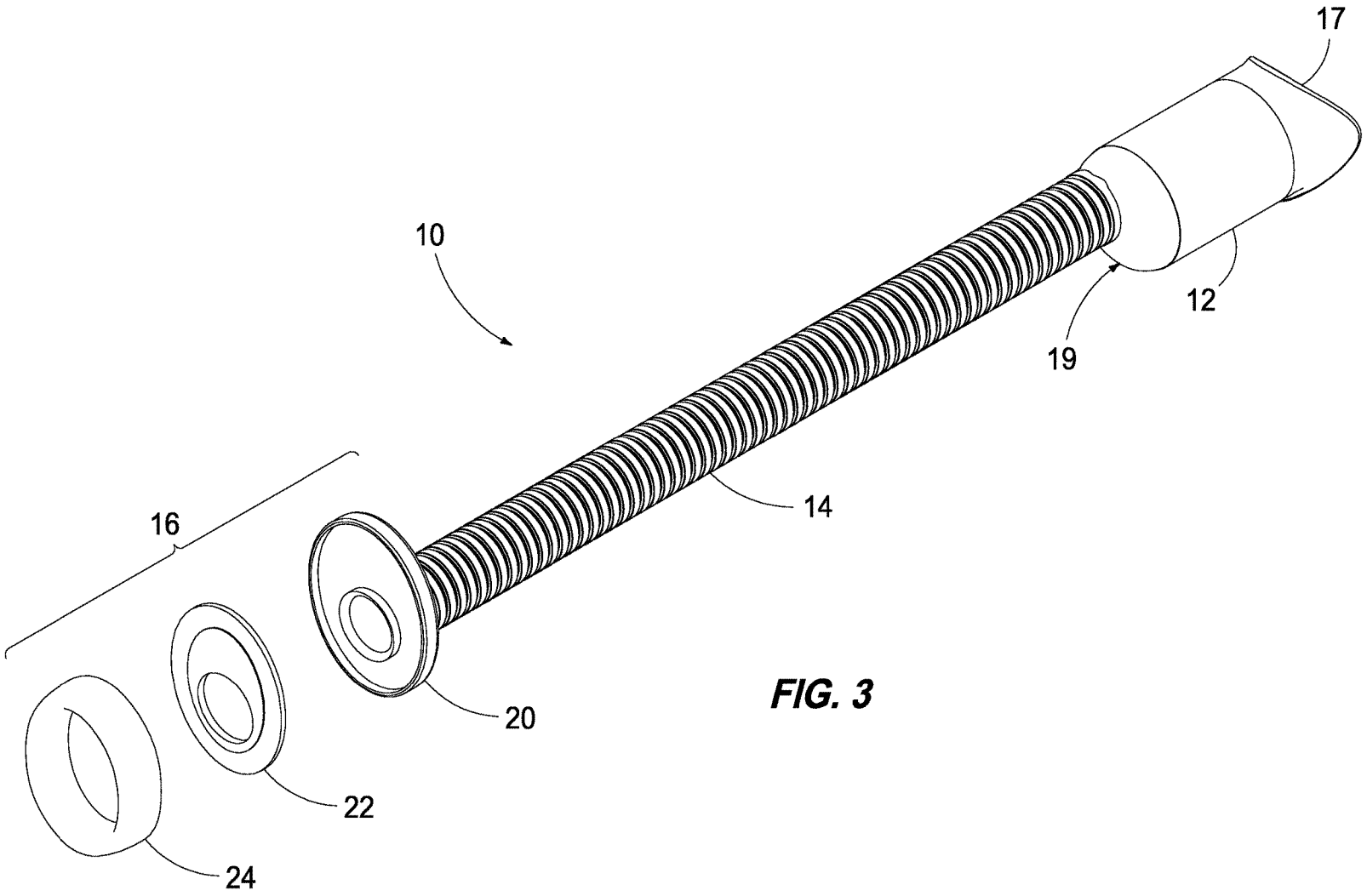
FIG. 3 is an upper exploded isometric view from a second end of an underwater voice communication device according to one embodiment.
Figure 4:
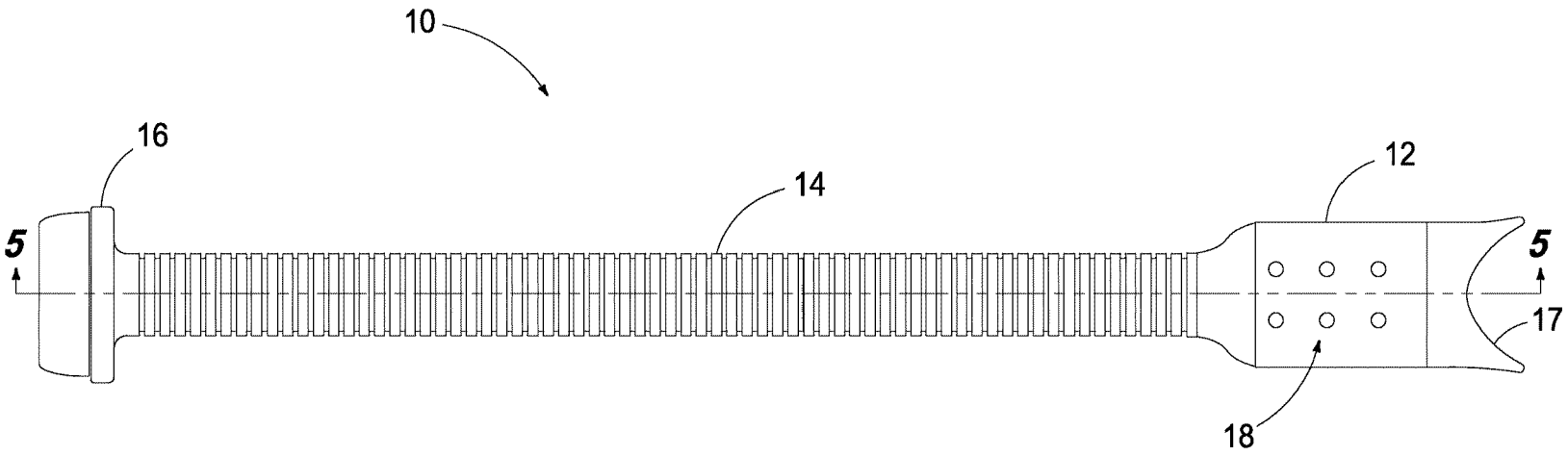
FIG. 4 is a plan view of an underwater voice communication device according to one embodiment.

This disclosure is submitted in furtherance of the constitutional purposes of the U.S. Patent Laws "to promote the progress of science and useful arts" (Article 1, Section 8).

The disclosure is directed towards apparatus and associated methods for facilitating voice communications between people underwater. At least some embodiments described below provide an underwater voice communication device which implements communications with no electronics, no power supply and few or no moving parts. The disclosed device is useful to implement voice communications between people underwater, including scuba divers, swimmers, snorkelers, children, etc.

As described below, the apparatus and methods of the disclosure allow one submerged user (the speaker or speaking person) to verbally communicate (talk) to another submerged person (the listener or listening person). In some additional embodiments, a single person may speak to more than one listener and plural people may talk and listen to plural other people. Another embodiment facilitates communications to an underwater video camera or other recording device that may be enclosed in a waterproof housing. One embodiment of the device is designed to be used by people in close proximity to one another (e.g., arm's length apart or closer), but may be used at further distances by lengthening an air tube of the device which is described below in some embodiments.

According to some embodiments, the underwater voice communication device is compact and easily fits into a pocket of the user, can be clipped onto the dive suit or buoyancy compensation device (BCD), or clipped to a protective shell which covers part of the device, and allows the user to quickly attach and remove the device from their dive suit.

Referring to FIGS. 1-9, an embodiment of the underwater voice communication device 10 is shown according to one embodiment. The illustrated device 10 includes a voice chamber 12, an air tube 14 and an earpiece 16. Other embodiments are provided, for example including embodiments which do not include an air tube as described below.

The device 10 works underwater by providing an airspace within the voice chamber 12, air tube 14 and earpiece 16 to communicate voice sound waves from the speaker's lips/face to the listener's eardrum in one embodiment. With a continuous airspace between the speaker's lips and the listener's eardrum, the speaker can clearly communicate with the listening person or persons. This airspace is referred to as a system airspace and is a substantially fixed internal volume of the device 10 in one embodiment. In some embodiments described below, the internal volume of the device 10 which provides the airspace includes internal volumes of voice chamber 12, air tube 14 (if present), and earpiece 16.

The voice chamber 12 includes a face seal 17 which is configured to form at least a substantially watertight seal with respect to the speaker's mouth during voice communications while the speaker is submerged in water. A perfect, completely watertight seal is not required as a slight leak (with an area less than about 1 square millimeter) at the interface of the face seal 17 and speaker's face caused by whiskers or the like will not cause malfunction as water will collect and exit the device 10 or air will escape in tiny bubbles (e.g., via one or more purge holes described below or around the face seal), neither of which will be an issue with respect to the voice communications. In one embodiment, the face seal 17 is configured to form at least the substantially watertight seal about the entirety of the mouth of the speaker.

In one embodiment, face seal 17 is formed of a smooth, rigid material, such as polycarbonate, and is shaped to comfortably fit most faces and is sufficiently sized such that an entirety of the speaker's mouth is within the face seal 17 during speaking (i.e., the face seal 17 forms a watertight seal with the skin around the lips of the speaker's mouth). In another embodiment, the face seal 17 is a soft, cushiony material, such as silicone rubber. The entirety of the voice chamber 12 including the face seal 17 may be formed of the same material in one embodiment. The voice chamber 12 includes an internal volume which is used to communicate voice sound waves from the speaker during use.

A lower portion of voice chamber 12 includes one or more purge holes 18 which are in fluid communication with the internal volume of the voice chamber 12 and the exterior of device 10 to allow water to exit the voice chamber 12 in the illustrated embodiment. Although six purge holes 18 are shown in the illustrated embodiment, more or less purge holes 18 are provided in other embodiments. Purge holes 18 may be relatively small and one more specific embodiment includes seventy purge holes 18 each having a diameter of 0.6 mm and which are spaced equidistantly apart from one another by 5 mm. Other example embodiments include a voice chamber 12 having six purge holes 18 which each have a 6 mm diameter, or a single larger purge hole may be used.

Although bubble noise does not interfere significantly with the listener's ability to hear the speaker, multiple small purge holes 18 are quieter than a single large hole and are less annoying to the speaker. The smaller diameter purge holes 18 are also useful for reducing noise when using the device 10 without the earpiece coupled to a listener's ear (e.g., recording the voice communications on a recording device or using the device in a "transmit sound thru the water" method outlined below).

Figure 6:
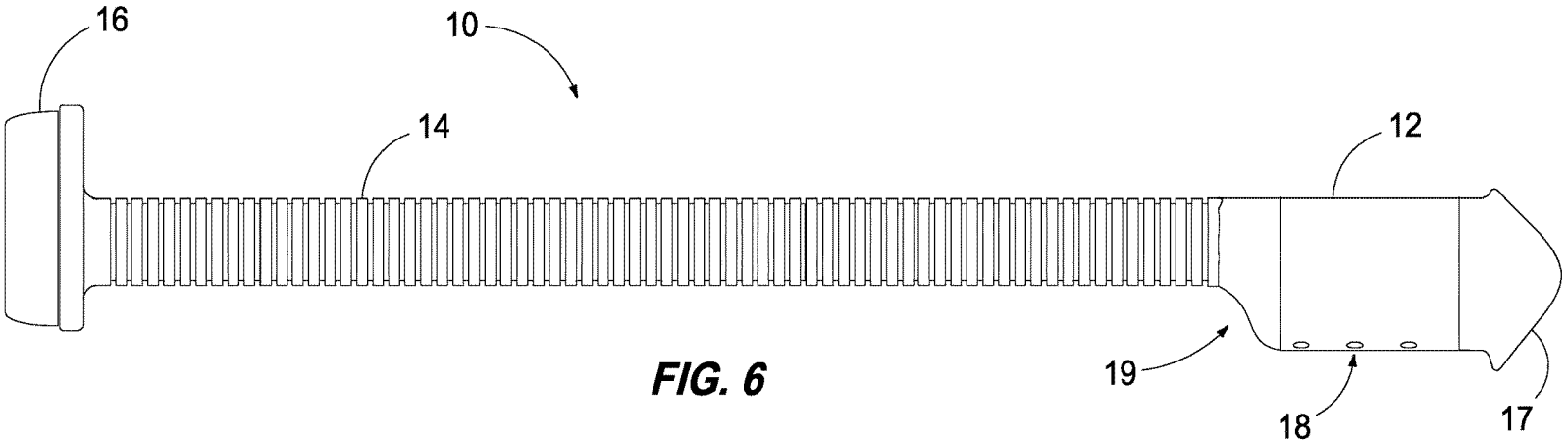
FIG. 6 is a front view of an underwater voice communication device according to one embodiment.
Figure 7:
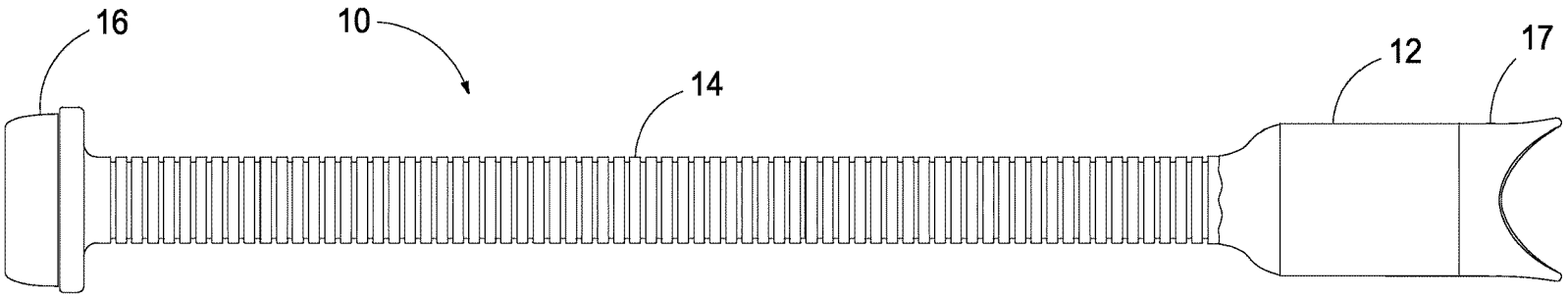
FIG. 7 is a bottom view of an underwater voice communication device according to one embodiment.
Figure 9:
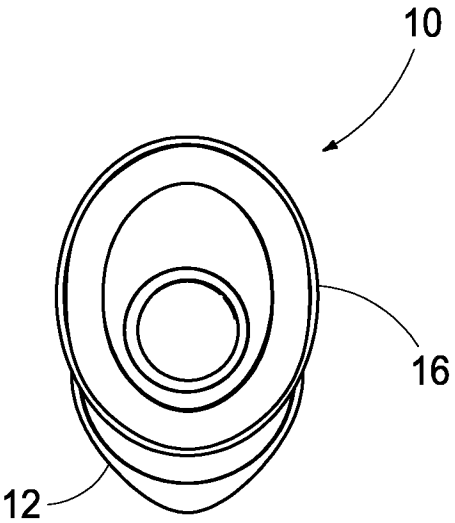
FIG. 9 is a right side view of an underwater voice communication device according to one embodiment.
Figure 8:
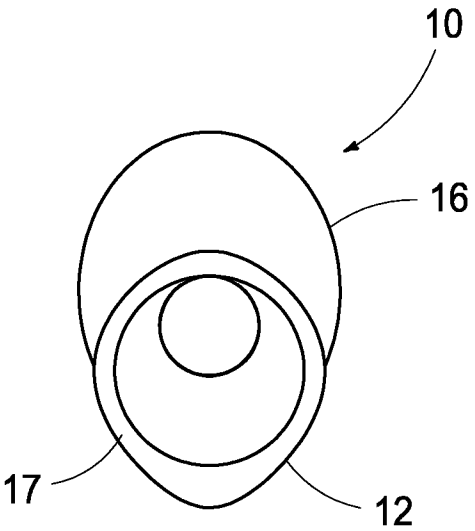
FIG. 8 is a left side view of an underwater voice communication device according to one embodiment.

In one embodiment, the voice chamber 12 is formed with an indent 19 to create a "sump" for water to collect before being purged via purge holes 18. For example, as shown in FIG. 6, the indent 19 of the voice chamber 12 extends downward below the air tube 14 to form a sump to collect water which may be exhausted from the device 10 through the purge holes 18 when the device 10 is held in the predefined position described below.

Figure 5:
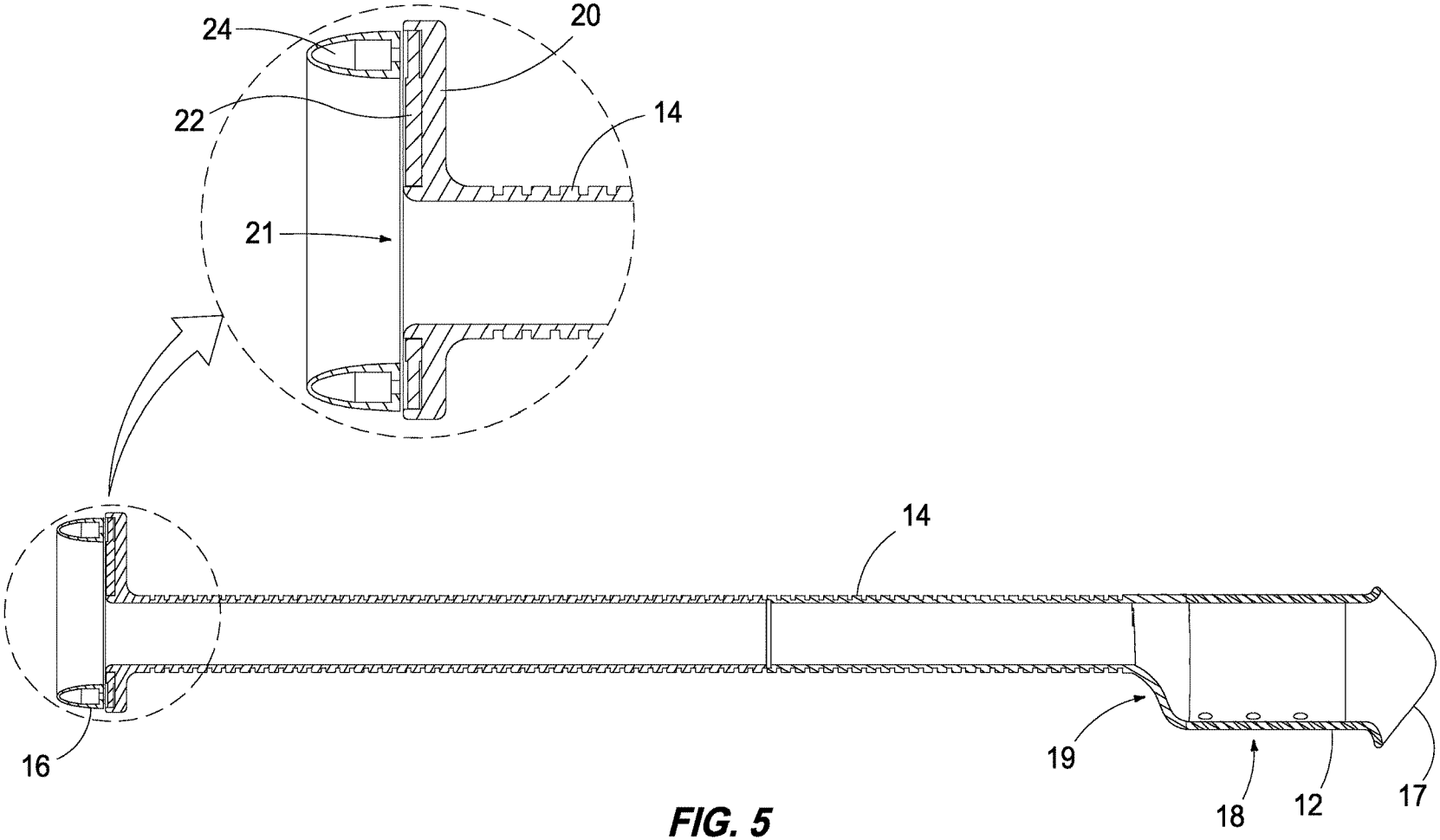
FIG. 5 is a front cross-sectional view of an underwater voice communication device according to one embodiment.

In one embodiment, the underwater voice communication device 10 is held in a predefined position during use as shown in FIG. 5 with the lower surface of the voice chamber 12 including the indent 19 facing downward (away from the surface of the water column) below the mouth of the user. In this position, the purge holes 18 are located at a lowest point of the underwater voice communication device 10 and indent 19 is configured to drain water from the internal volumes of the earpiece 16, air tube 14 and voice chamber 12 to the purge holes 18.

During use, the air tube 14 may be held relatively straight and downhill from the listener to the speaker which allows any water within the earpiece 16 and air tube 14 to drain by flowing downhill to the voice chamber 12 and out the purge holes 18.

Figure 11:
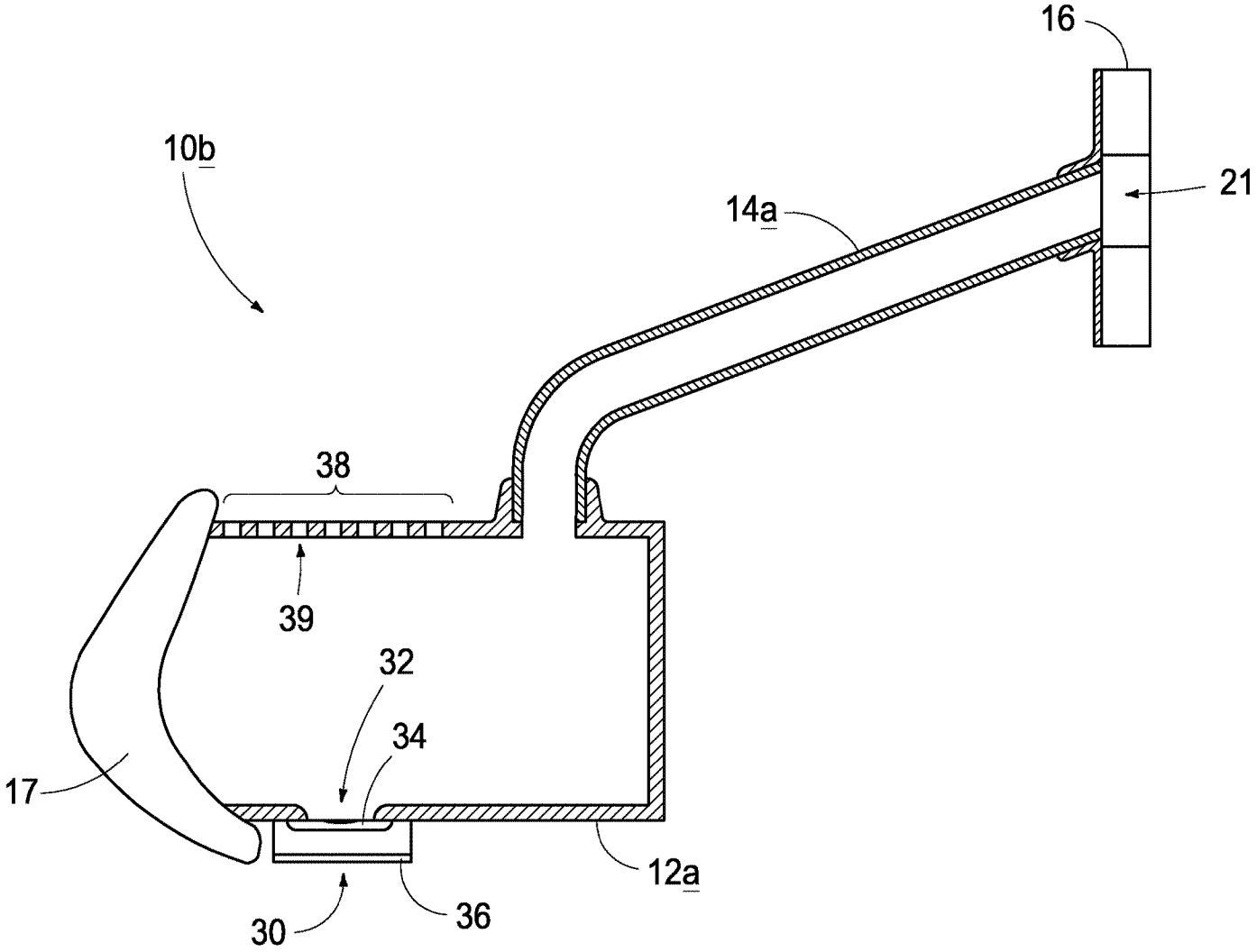
FIG. 11 is a front cross-sectional view of an underwater voice communication device according to one embodiment.

An upper surface of the voice chamber 12 (i.e., the surface opposite to the lower surface which includes purge holes 18) of the arrangement shown in FIGS. 1-9 may include a bubble silencer in some embodiments as discussed with respect to FIG. 11. The bubble silencer provided in the upper surface of the voice chamber 12 in one embodiment faces upwards (towards the surface of the water column) during use. When used with an audio recording device as described in some embodiments, the bubble silencer provides improved recording of audio by reducing the presence of large bubbles which may otherwise interfere with recorded speech.

Air tube 14 may be constructed to have different diameters and/or cross sectional shapes which define an internal volume and provides an air passage between the internal volumes of voice chamber 12 and earpiece 16 in different embodiments of the device 10. In addition, the air tube 14 is optional as described below with respect to one example embodiment shown in FIG. 10 where earpiece 16 is connected directly to the voice chamber 12. The internal volume of air tube 14 is in fluid communication with the internal volumes of voice chamber 12 and earpiece 16 and is used to communicate voice sound waves from the speaker to the listener during use.

The internal volume of device 10 fills with water when submerged and this water is purged from the device 10 to provide an airspace underwater from the speaker's mouth to the listener's ear. For example, prior to speaking, the speaker may blow air into the device 10 (with the device 10 sealed to the mouth of the speaker and head of the listener) to purge the water from the device 10 through the purge holes 18.

Figure 17:
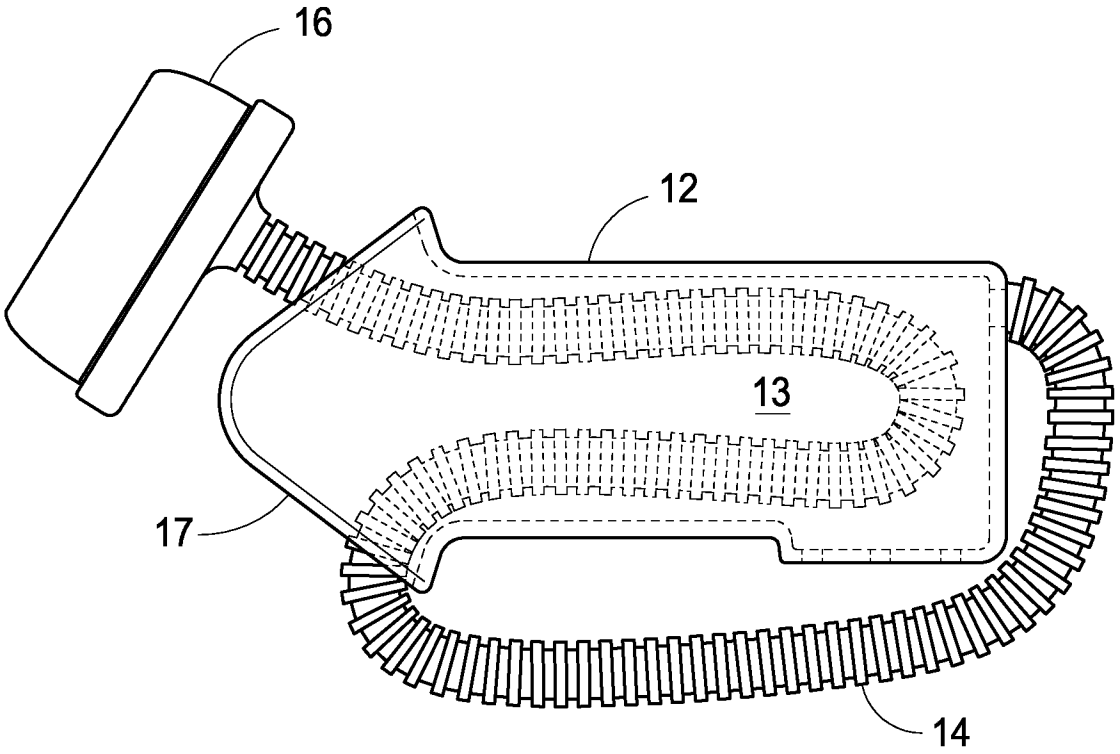
FIG. 17 is an illustrative representation of an underwater voice communication device configured for storage or transportation according to one embodiment.

In one embodiment, air tube 14 is clear or nearly clear which allows the speaker to see that the water has been cleared from the air tube 14 following the purging and thus insuring that the airspace is established to the listener's ear before speaking. In one embodiment, air tube 14 is flexible, made of a medium durometer silicone rubber (Shore A 50 to 60 durometer) and has a corrugated outer wall with a wall thickness that varies from 1.3 mm to 4 mm. Air tube 14 having the corrugated design in one embodiment provides flexibility (for example to allow compact storage within voice chamber 12 as discussed with respect to FIG. 17) while reducing kinking problems which may block passage of air or water through device 10. In one embodiment, air tube 14 has a smooth interior surface to facilitate drainage of water from the tube 14.

In different configurations, the inside diameter of air tube 14 may range from 12 mm to 50 mm and have a length within the range of zero (embodiments where no air tube 14 is present) to over 1 meter. The different sizes have different characteristics. For example, air tubes 14 of smaller diameters have diminished sound quality and volume at the earpiece 16, require less purge air volume to purge water, but require more time to allow the water to clear the tube 14 when purging. Air tubes 14 of larger diameters preserve good sound quality but require more air to purge the water, and require more material to manufacture.

Air tubes 14 of longer lengths allow the users more separation when communicating, but make it more difficult to maintain a relatively straight tube when purging that allows the water to flow downhill to the voice chamber 12 and out the purge holes 18. Also, if the speaking user is at a much greater depth than the listening user, the pressure inside the device 10 may make it harder for the listener to form an air tight ear seal due to the pressure difference at the ear seal. More specifically, the pressure inside the device 10 will be at the pressure of the speaking user and if the listening user is 1 meter above the speaker, the pressure difference across the ear seal will be 0.1 atmosphere, or 1.47 psi, which may make it difficult to keep a tight, hand held seal.

It is desired for air tube 14 to be fairly unrestricted when purging the water, but it may be reduced in cross section after purging and during use, for example by accidentally twisting or kinking as the users move around during use, without significantly reducing the audibility of the speech.

In one embodiment, air tube 14 is connected to a lower portion of ear piece 16 so that water present in the earpiece drains into the air tube 14 and voice chamber 12 and exits the device 10 via purge holes 18 during purging.

In some embodiments, air tube 14 has an inside diameter of 26 mm with a length of 400-500 mm resulting in an internal volume of approximately 210 to 270 mL for the air tube. In one more specific example arrangement of device 10, air tube 14 has a constant inside diameter of 26 mm and length of 400 mm and voice chamber 12 has a diameter of 50 mm and a length of 70-90 mm long with six purge holes 18 each 6 mm in diameter and which optimizes clearing time without wasting air when purging the device 10. Air tubes 14 of other lengths and diameters can be matched with voice chambers 12 and purge holes 18 of different sizes in other arrangements.

Different earpieces 16 may be used in different embodiments including three different types (circumaural, supra-aural and earbud) in illustrative examples. A circumaural earpiece is larger than supra-aural or earbud earpieces and may have a cup-like shape that completely encloses the outer ear and seals against the divers head. A supra-aural earpiece is pressed against and in contact with the ear while covering most of the outer ear. An ear bud earpiece is smaller than the other earpieces and has a shape that fits into the ear canal of the listener. The ear piece 16 has an internal volume which is used to communicate voice sound waves from the voice chamber 12 and air tube 14 to the listener's ear during use.

The earpiece 16 shown in FIGS. 1-9 is a circumaural type of earpiece, where the entire outer ear of the listener fits inside the earpiece when in use. In some embodiments, circumaural and supra-aural earpieces 16 are constructed with a rigid member 22, such as rigid back plate, usable by the listener to press the ear seal against their head and/or ear. At least a substantially watertight seal is formed with respect to the listener's ear or head by ear seal 24 when the listener applies a small force to the rigid member 22 (small unsealed locations of less than 1 square millimeter or so allow small bubbles to escape as the speaker talks, and these do not interfere with proper function).

In one embodiment, member 22 is formed of polycarbonate and includes three or more indentations or finger cups (not shown) so that the user's fingers will fit comfortably in the indents and will guide the user to apply proper pressure to the earpiece 16 so that a proper seal is formed. The earpiece 16 may be elliptical in shape so that it fits either right or left ears equally well.

In example embodiments described below, ear seal 24 comprises a conformable member which is configured to form the at least substantially watertight seal with respect to the ear of the listener and about an aperture 21 of the earpiece 16 to provide the internal airspace of the device 10 in fluid communication with the listener's ear to permit the speaker to communicate with the listener. In example embodiments, a supra-aural earpiece is deformable so that it conforms against the outer ear, and a circumaural earpiece is deformable so it conforms to the head.

Accordingly, in one embodiment, ear seal 24 is constructed of any material that easily deforms to create at least a substantially watertight seal against or around the listener's ear or against the listener's head. In one more specific embodiment, ear seal 24 is configured to form at least the substantially watertight seal about the entirety of the ear of the listener. Open cell, hi density foams (such as urethane foam or sponge—"memory foam") may be used for the ear seal 24 in one embodiment. A soft, semisolid material, such as a low durometer silicone rubber (Shore A 10 to 15 durometer) or a gel-filled torus shaped pad with a durable fabric or flexible outer layer (such as a Shore A 50 durometer silicone rubber 1 mm outer layer filled with Shore A 00 to 20 durometer silicone gel) may be used for the ear seal 24 in other embodiments. In addition, the ear seal 24 may be a double flange type seal similar to one commonly used in face seals of typical dive masks in some embodiments.

In some implementations, earpieces 16 may be constructed so that all divers wear them constantly when under water. Another user may connect a voice chamber 12 and air tube 14 to the earpiece 16 worn by the user underwater, purge water from the components and begin speaking in these implementations. Further, custom fitted earpieces 16 may be used and any of the appropriate earpieces 16 may be attached to the diver's head and/or ear by various means, such as headbands or straps, and allowing the listener to be hands free of the device.

As discussed, different sizes, types and dimensions of voice chamber 12, air tube 14 and earpiece 16 may be used in different embodiments of device 10. A normal "full breath" for the average male is approximately 4.6 liters and 3.1 liters for the average female. In scuba diving, a breath is somewhat less than full, and does not vary at all with depth. In some embodiments, voice chamber 12 may have a diameter within the range of 35 mm to 150 mm and a length within a range of 40 mm to 300 mm. The larger and smaller volumes that result from the extremes of these dimensions produce less than optimal audio quality for the listener compared with dimensions in the middle portions of these ranges. In one embodiment, voice chamber 12 having a volume in the range of 130 to 180 mL produces optimal audio quality for human speech. Voice chambers 12 having diameters smaller than 35 mm typically do not provide sufficient interior space for the speaker's lips to correctly form speech sounds. In addition, a voice chamber 12 of a larger diameter would be used with a smaller face seal 17 to form a watertight seal around the speaker's mouth which may add to manufacturing complexity and larger volumes also require more air to purge the device 10 of water for use. Accordingly, in more specific embodiments, voice chamber 12 has a diameter of approximately 50 mm and is 70-90 mm in length (resulting in a construction having a volume of approximately 140 to 180 mL), allowing ease in manufacturing, requiring a relatively small volume of purge air before speaking and providing good audio quality in the range of human speech.

The above-mentioned voice chamber 12 has a volume which provides good sound quality for human voices while being a size which is comfortable to use yet compact for easy storage. In addition, voice chambers 12 having larger volumes and/or air tubes of increased lengths may create resonance at certain frequencies which distorts the voice and interferes with the clarity/intelligibility.

In one embodiment, earpiece 16 has an internal volume which is an elliptical cross section (60 mm×45 mm) and approximately 20 mm deep providing a volume which is about 45 mL (approximately half of which will be taken up by the listener's ear) and which is in fluid communication with the internal volume of the voice chamber 12 and internal volume of air tube 14 if present.

A total system volume of device 10 is the sum of the internal volumes of the components of device 10. The example embodiments of device 10 described above have a total device volume of approximately 370 mL to 470 mL (e.g., 140 to 180 mL for the voice chamber plus 210 to 270 for the air tube plus 23 mL for the earpiece). This amount of air may be used to purge the device 10 of water to be ready to begin speaking using the device 10 and which is approximately 8-10% of a full breath for an average male and 12-15% for the average female.

Figure 10:
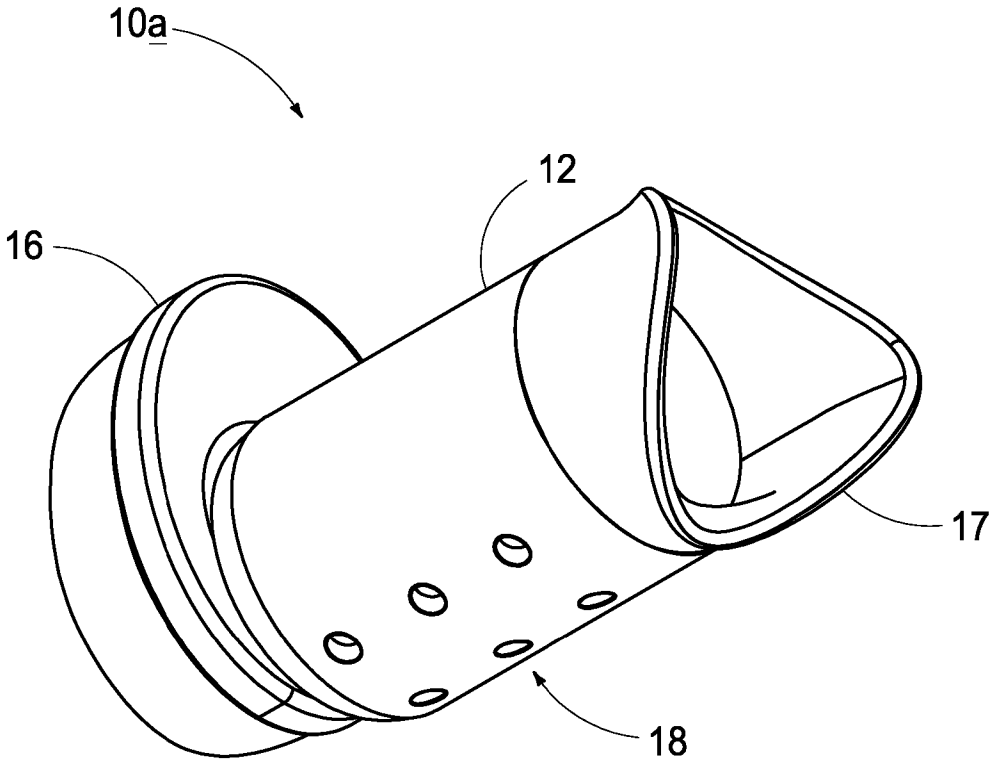
FIG. 10 is an isometric view of an underwater voice communication device according to one embodiment.

Referring to FIG. 10, another embodiment of the underwater voice communication device 10*a* is shown. The air tube is not included in device 10*a* and the voice chamber 12 and earpiece 16 are directly connected within one another with an air passage connecting the internal volumes of voice chamber 12 and earpiece 16 during use. In this arrangement, the earpiece aperture 21 may be coupled with an outlet of the voice chamber 12 which is coupled with the air tube in the embodiment shown in FIGS. 1-9 and which provides the air passage connecting the internal volumes of voice chamber 12 and earpiece 16. The device 10*a* may be held in the illustrated orientation during use, and as described above, aperture 21 may be positioned at a lower portion of the earpiece 16 to permit water to drain from the earpiece 16 into voice chamber 12 and out of purge holes 18 in one embodiment.

Referring to FIG. 11, another embodiment of the underwater voice communication device 10*b* which includes an air tube 14*a* is shown. In one embodiment, voice chamber 12*a* is formed of a rigid plastic while air tube 14*a* is flexible plastic or rubber. The device 10*b* may be held in the illustrated orientation during use (with the air tube 14*a* connected with an upper surface of the voice chamber 12 which faces upwardly towards the surface of the water column) and which permits any water in the earpiece 16 and air tube 14*a* to drain into voice chamber 12*a* during use. Water in the voice chamber 12 may drain out of the device 10*b* via a purge valve assembly 30 in the depicted arrangement. This arrangement also prevents any residual water in the device 10*b* from blocking the air tube 14*a*.

The purge valve assembly 30 forms a one-way, exit only port which is configured to allow fluids to pass from the internal volume of the voice chamber 12 to the exterior of the underwater voice communication device 10. The purge valve assemblies discussed herein may be used in the other disclosed embodiments (e.g., the embodiments of FIGS. 1-10 and 14-15) to create one-way, exit only ports via one or more of the purge holes 18.

The illustrated embodiment of purge valve assembly 30 includes a flapper 34 (e.g., flexible silicone rubber membrane) which seals an aperture 32 to form the purge valve and an external guard 36 in the form of a housing open to the exterior of the device 10 protects assembly 30 from contact or interference during use. The flapper 34 seals the aperture 32 while the speaker speaks into device 10 as there is a slightly less pressure inside voice chamber 12 compared with the exterior of the device 10. If the speaker exhales air into the airspace of the device 10 at a rate greater than normal when speaking, any excess air may be vented to the exterior of the device 10 by the purge assembly 30.

Any water in voice chamber 12 may drain out of device 10 via the aperture 32 during purging operations. Purge assembly 30 (or purge assembly 30*a* of FIGS. 13 and 13A) may include a plurality of apertures 32 which are sealed by respective flappers 34, 34*a*. The one or more apertures 32 of purge assemblies 30, 30*a* may also be referred to as purge holes which operate to purge fluids to the exterior of the device 10. In another embodiment, the purge valve assembly 30 of FIG. 11 is replaced with one or more purge holes 18 described above.

Device 10*b* also includes a bubble silencer 38 in the illustrated embodiment which allows speaking air (the air used in producing speech) to be vented outside of the device 10 with decreased noise which reduces interference with the speech. Although not shown, the other embodiments of the underwater communication device described herein may also include a bubble silencer.

In one embodiment, bubble silencer 38 includes a plurality of apertures 39 which are located in a substantially flat surface located at the upper surface of voice chamber 12 (at the high point in the voice chamber 12 where the ambient pressure is lowest) when the device 10 is held in the predefined position, such as shown in FIG. 11. This allows the speaking air exhaled by the speaker to exit the voice chamber 12 through apertures 39 to the exterior of device 10 with the least resistance reducing back pressure on the speaker which would otherwise make speaking more difficult.

In addition, large bubbles generate relatively high volume noise when rising upward thru a water column. Very small bubbles create only a low volume hissing sound. Bubbles increase in volume as they rise due to the lower ambient pressure in accordance with the Ideal Gas Law of physics (Pressure×Volume/Temperature=a constant). As the bubbles rise and expand, they coalesce into larger bubbles, generating more noise. Bubble size is dependent on the hole size of apertures 39 and flow rate, and the bubbles are larger than the hole size of apertures 39. The separation distance of apertures 39 utilized depends on the size of apertures 39 in some embodiments. The bubble silencer 38 utilizes apertures 39 which have a diameter less than the spacing of the apertures 39 from one another in one embodiment. With enough space between the apertures 39, the bubbles do not connect until well above the diver. Bubble silencer 38 is configured with a ratio of aperture spacing to aperture diameter of at least 8:1 in some embodiments.

In one embodiment, to obtain a relatively small area requirement for the bubble silencer 38 (increased air flow in a small area), approximately 30 to 100 small (e.g., less than 1 mm or within a range of 0.5 to 0.7 mm diameter) apertures 39 are equidistantly spaced from one another (5 to 7 mm apart).

In a more specific embodiment of bubble silencer 38, the apertures 39 are provided through a 1 mm thick substantially flat PTFE panel with 75 apertures 39, each of 0.6 mm diameter equidistantly spaced 5 mm apart from one another in a two dimensional grid pattern in one embodiment. It is desired to maintain the bubble silencer 38 in a substantially horizontal position during speaking in one embodiment.

The speaking air forms tiny bubbles when leaving the bubble silencer 38 which do coalesce until they travel a distance above the users where the noise does not interfere with the hearing of the listener or the recording of speech by a recording device. The bubble silencer 38 does not allow significant water entry into the voice chamber 12 during use due to the pressure inside the voice chamber 12 being slightly higher than the pressure of the water outside the bubble silencer 38, and air is flowing out of the bubble silencer 38 during speaking.

Figure 13:
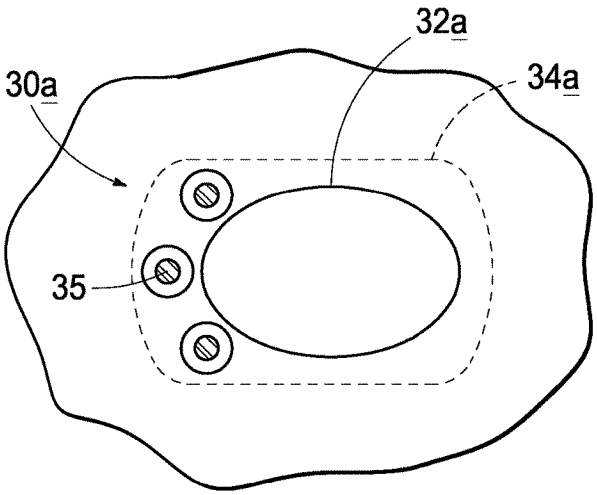
FIG. 13 is a plan view of a purge valve assembly according to one embodiment.
Figure 13A:
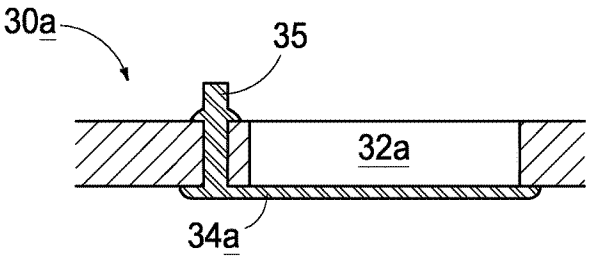
FIG. 13A is a cross-sectional view of the purge valve assembly of FIG. 13 according to one embodiment.
Figure 12:
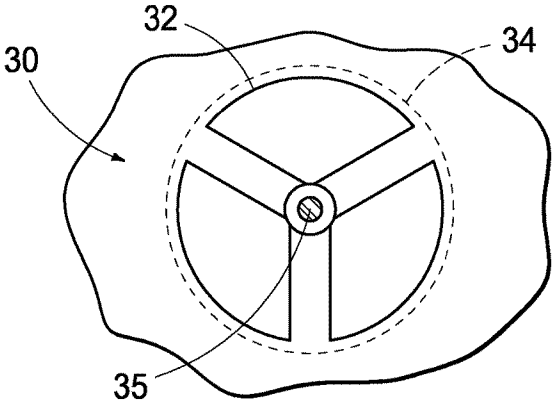
FIG. 12 is a plan view of a purge valve assembly according to one embodiment.

Referring to FIGS. 12-13A, example configurations of purge valve assemblies 30, 30*a* are shown. Other arrangements of the purge valve assembly including other types of one-way valve configurations may be used in other embodiments.

Figure 12A:
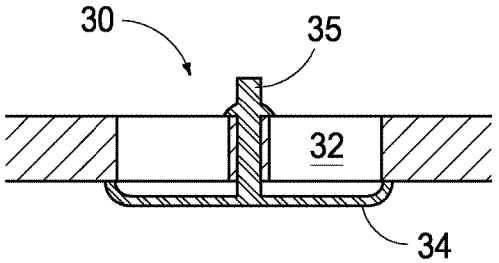
FIG. 12A is a cross-sectional view of the purge valve assembly of FIG. 12 according to one embodiment.

In the arrangement shown in FIGS. 12 and 12A, the aperture 32 within the lower wall of voice chamber 12 is circular. A rubber flapper 34 is sized to cover the entirety of aperture 32 thereby forming a seal. A post 35 of the flapper 34 extends upwardly for securing and retaining the flapper 34 in proper position with respect to aperture 32. During purging, the purge air from the speaker forces the flapper 34 to open downwardly which permits fluids within the voice chamber 12 to vent to the exterior of the voice chamber 12 while preventing exterior water from entering the internal volume of the voice chamber 12.

An alternative arrangement of purge valve assembly 30*a* is shown in FIGS. 13 and 13A where the aperture 32*a* within the lower wall of voice chamber 12 is elliptical. A rubber flapper 34*a* is sized to cover the entirety of aperture 32*a* thereby forming a seal. Plural rubber posts 35 of the flapper 34*a* extend upwardly for securing and retaining the flapper 34*a* in proper position with respect to aperture 32*a*.

Additional functionality of purge holes 18 and purge valve assemblies 30, 30*a* are described below. The purge holes 18 or assemblies 30, 30*a* act to prevent excessive pressure from being applied to the listener's ear drum. For example, if the speaker blows into the voice chamber 12 with any force, the purge holes 18 or assemblies 30, 30*a* vent the pressure from the device 10 thereby protecting the eardrum of the listener.

As mentioned above, the purge valve assemblies 30, 30*a* prevent water from entering the voice chamber 12 through apertures 32, 32*a*. For arrangements without purge valve assemblies 30, 30*a*, water will not enter the voice chamber 12 as long as the device 10 is held in the predefined position with holes or assemblies 30, 30*a* facing downwardly away from the surface of the water column, the earpiece 16 is sealed to the listener, the face seal 17 is sealed to the speaker, and the speaker does not inhale.

The speaker may pause their speech momentarily and resume at any time without needing to clear the device 10 a second time. If the speaker wishes to take a breath, they may remove their face from face seal 17, take a breath from their regulator, reseal their face against face seal 17, purge voice chamber 12 (the air tube 14 and the air chamber of earpiece 16 will remain filled with air as long as the ear seal 17 is sealed to the listener's head or ear and the voice chamber 12 remains the lowest point in the device 10).

When a speaker desires to use the device, they purge the water from the internal volume of the device 10 to provide an airspace as discussed above. The purge holes 18 and assemblies 30, 30*a* allow the speaker to clear the water from the device 10. In some embodiments, it is desirable to completely purge the internal volume between the speaker and listener (i.e., the internal volume of device 10 including internal air volumes of voice chamber 12, air tube 14 and earpiece 16) with as little air as possible, in as short of time as possible, so that the speaker can begin speaking as soon as possible. It is desirable for a speaker to purge device 10 in a relaxed, natural fashion without excessive breathing force. The device 10 is designed to be easily and quickly purged (e.g., within 2 seconds or less) by the speaker using a normal breathing force.

Factors of device 10 affecting purge time include the sizes of the internal volumes of the voice chamber 12, air tube 14 and earpiece 16; the diameter, length and inner surface smoothness of the air tube 14 (air tubes 14 having relatively smaller diameters take longer for the water to drain from the earpiece 16 and the air tube 14 into the voice chamber 12 due to surface friction caused by viscous effects generated by the surface of the air tube 14, relatively longer tubes 14 take longer to drain, and tubes 14 having relatively smooth interior surfaces drain faster than courser surfaces); and fluid dynamics of the purge holes 18 or purge valve assembly 30, 30*a* (significant variables are size and number of purge holes 18).

For a given internal volume of the earpiece 16 and a given diameter and length of air tube 14, there is a fixed minimum time that is required for the water in the air tube 14 and earpiece 16 to be replaced by air when purging. In one embodiment, the air tube 14, earpiece 16, the voice chamber 12 and the purge holes 18 are sized so that the air tube 14 and earpiece 16 are emptied of water just as the voice chamber 12 is emptied which provides a completely purged device 10 in minimal time and with minimal wasted air for speaking.

In particular, if the purge holes 18 are numerous and relatively large, the water that was originally in the voice chamber 12 will be emptied before the water has cleared the air tube 14 which causes the purge air to escape thru the purge holes 18 resulting in increased use of the speaker's air. If the purge holes 18 are few and relatively small, the air tube 14 will be emptied before the voice chamber 12, lengthening the time it takes to clear the water from the internal volume of the device 10. Accordingly, in one embodiment, optimal results (shortest purge time without loss of air) are obtained by sizing all components of the device 10 so that the air tube 14 just empties as the last of the water is exiting the voice chamber 12.

In one embodiment, as the speaker begins blowing purge air into the device 10, the air initially fills only the top of the voice chamber 12, and begins flowing up into the air tube 14, while water begins flowing out of the air tube 14 into the voice chamber 12. As this process continues, the air reaches the earpiece 16, and eventually the earpiece 16 and the listener's ear canal are completely filled with air, while water is still draining down the air tube 14 into the voice chamber 12. Eventually the air tube 14 is completely clear of water, having drained into the voice chamber 12 and out the purge holes 18. The voice chamber 12 is then finally cleared of the last of the water. This draining of water occurs in two seconds or less for one embodiment of device 10 having a voice chamber 12 which is 50 mm in diameter×90 mm in length, an air tube 14 which is 26 mm in diameter×450 mm in length, and an elliptical earpiece 16 which measures 60 mm×45 mm and is 20 mm deep.

Other designs of device 10 are possible with one or more of the voice chamber 12 (and purge holes 18/purge assembly 30, 30*a*), air tube 14 and/or earpiece 16 not being configured for optimal purging discussed above. For example, device 10 may be used as a pool tool for children who may not be concerned with optimal purging and the device 10 may not be designed for optimal purging to achieve a reduced manufacturing cost. For example, the air tube 14 may have a smaller inside diameter in such embodiments.

In one operational embodiment to purge the internal volume of device 10 of water to form an airspace, the two users position themselves so that the speaker is below the listener (i.e., the speaker is lower in the water column than the listener) so the purge holes 18 are at approximately the lowest point of device 10 during use, although the difference in elevation is not critical. In particular, for the above-described embodiments, any angle between the users of 10 to 70 degrees from horizontal allows the water to flow from the earpiece 16 and air tube 14 to the voice chamber 12 and out of device 10 in minimal time (e.g., less than 2 seconds in some embodiments). Lesser or greater angles will also purge adequately, but at a slower rate.

The listener presses the earpiece 16 over their ear (right or left at the discretion of the divers) to form at least a substantially watertight seal. The speaker removes their regulator from their mouth, presses the face seal 17 to surround an entirety of their mouth thereby forming a watertight seal. The speaker then purges the device 10 by slowly exhaling a small volume of air for about two seconds, or speaking a short phrase (such as "hello, hello, hello" or other phrase that has a lot aspirated syllables), as speaking delivers a gentle, continuous flow of air that is ideal for quickly clearing the internal volume of device 10 to provide an airspace to communicate the voice sound waves. As the internal volume of device 10 is substantially fixed, the air displaces the water, and water being heavier than air flows to the low point in the device 10 and out the purge holes 18 or purge assembly 30, 30*a*. This purging air clears the water from the voice chamber 12, the air tube 14, the earpiece 16 and the listener's ear canal. When air escapes the purge holes 18, the air escaping through the purge holes 18 create a loud noise, thus the user will know that device 10 is clear of water and the airspace from the mouth of the speaker to the ear of the listener is present and the speaker may begin communicating by speaking. The internal volume of device 10 does not need to be completely dry for communications of high audible quality and some water can remain in the device 10 as long as there is a continuous air path from the speaker's vocal cords to the listener's ear. The speaker now speaks at normal or quiet speaking volume, and the listener hears the speech with very hi fidelity and at a comfortable volume.

In embodiments that also have bubble silencers, some air will escape thru the bubble silencer as the water is purging from the device 10. The quantity of this air is minimal and insignificantly increases the purge time. Users will quickly develop a feel for how much purge air is required and will naturally adjust their purging time or effort to properly purge the device 10. For example, when using the phrase "Hello, Hello, Hello" to purge, simply lengthening the "o" sound will provide the additional purge air needed.

Once the water is purged from the device 10, the divers are free to change position with respect to one another, and the listener can now be below the speaker as long as the housing of voice chamber 12 remains oriented with the purge holes 18 or purge assembly 30, 30*a* oriented downward (away from the surface of the water column) to prevent water from entering the voice chamber 12 through purge holes 18 or purge assembly 30, 30*a*. As the speaker talks, the speaking air exits the purge holes 18 or purge assembly 30, 30*a* in the described embodiments. As the sealed device 10 is isolated from the listener's ear, bubble noise does not interfere with audibility or intelligibility. Speakers should talk in a normal to quiet voice, as the device provides for very clear and very efficient sound transmission.

In some implementations of use, two of the above-described embodiments of device 10 can be used simultaneously to carry on a two way conversation between two users.

Other embodiments are possible based upon the above-described underwater voice communication devices. For example, in some embodiments, two-way voice conversations may be provided using a single underwater voice communication device (the above-described embodiments of the underwater voice communication device are used for a one-way conversation from a speaker to a listener) with two voice chambers and two earpieces being connected to a single air tube. Furthermore, other underwater voice communication devices may provide voice communications between more than two users. For example, other embodiments of the underwater voice communication device may be constructed with multiple voice chambers 12 and/or multiple earpieces 16 which are all interconnected by a common air tube.

Figure 14:
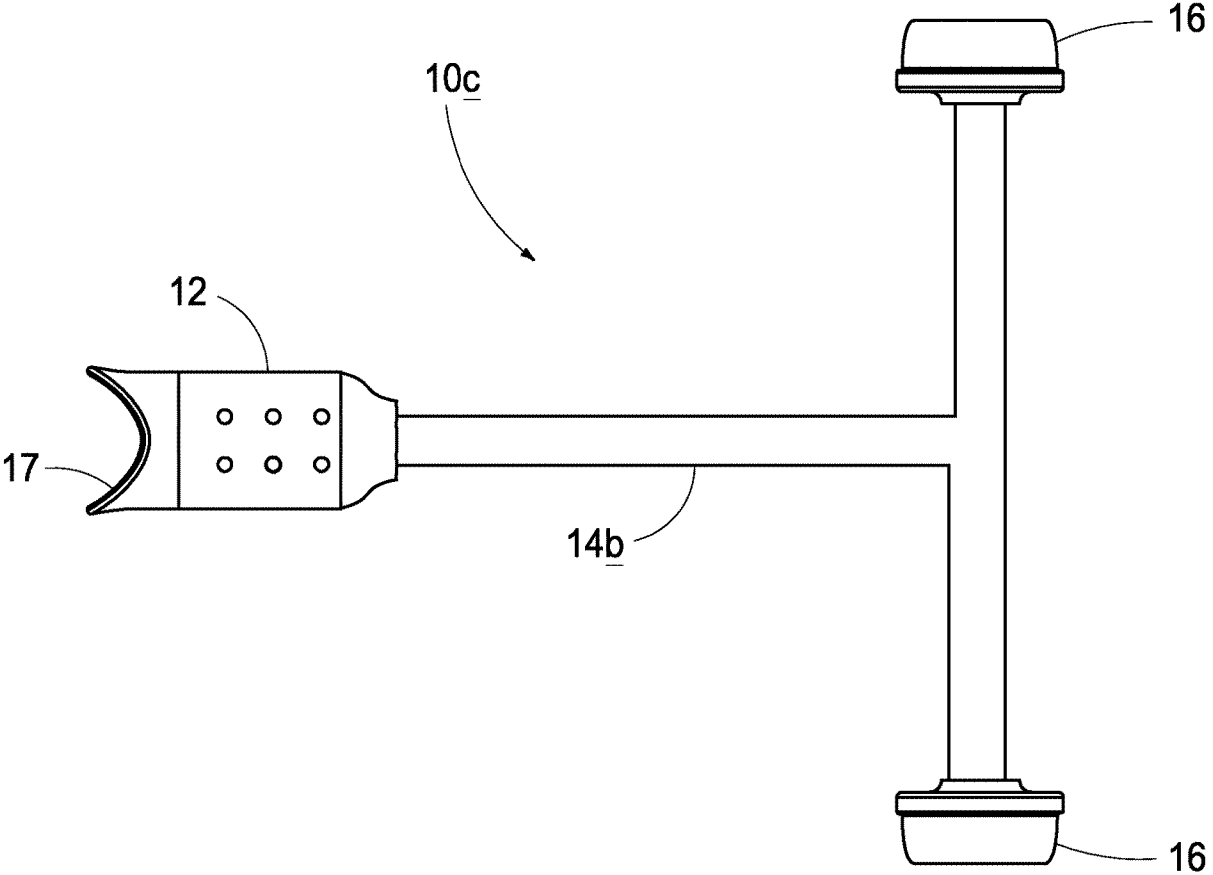
FIG. 14 is a plan view of an underwater voice communication device according to one embodiment.

Referring to FIG. 14, one embodiment of underwater voice communication device 10*c* is shown which provides voice communications from a single speaker via an air tube 14*b* to multiple listeners. As shown, this example embodiment includes a single voice chamber 12 for the speaker and two earpieces 16 for two listeners which hear voice communications from the speaker via air tube 14*b*.

Figure 15:
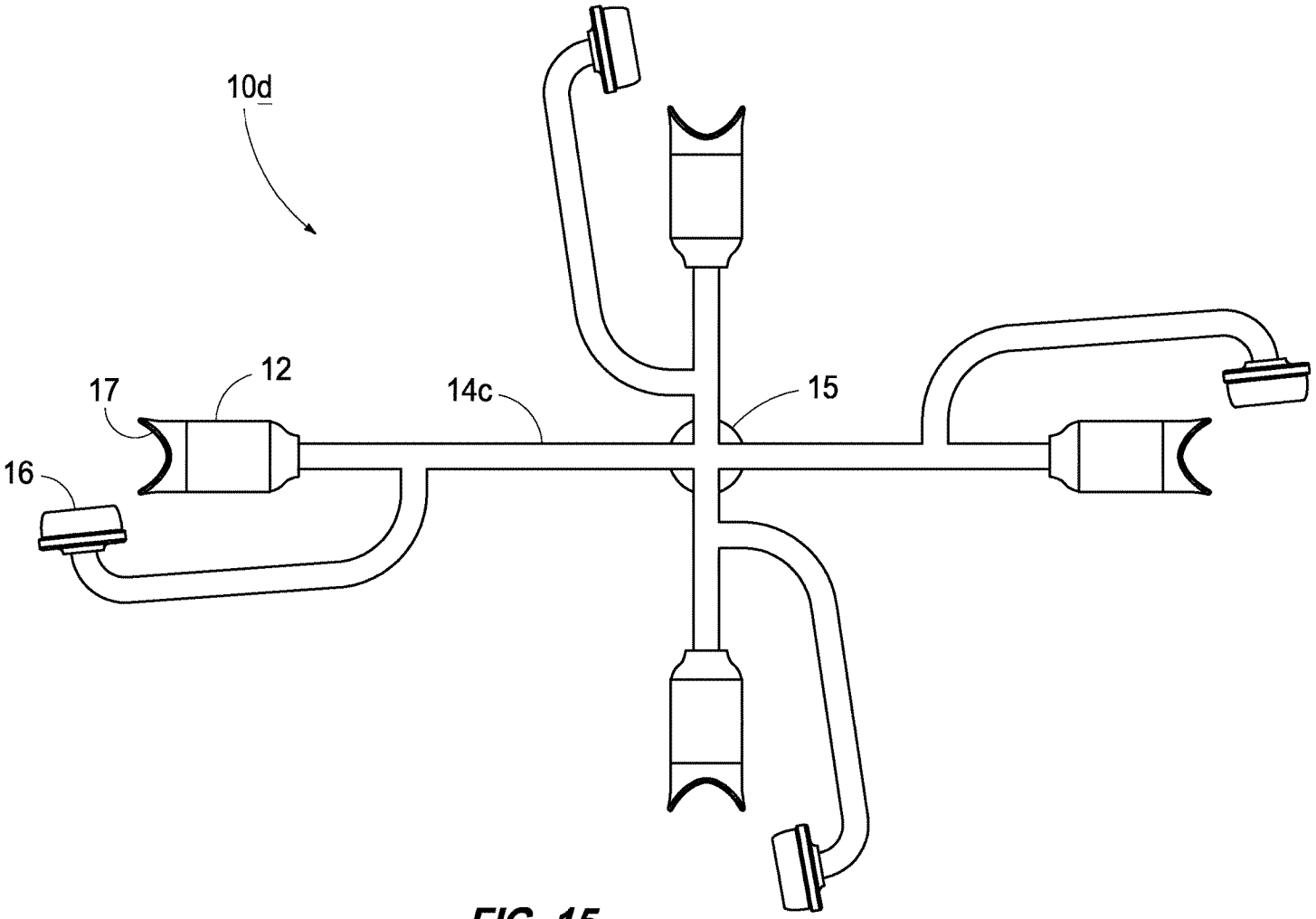
FIG. 15 is a plan view of an underwater voice communication device according to one embodiment.

Referring to FIG. 15, one embodiment of underwater voice communication device 10*d* is shown which enables two-way communications between four people. In particular, a single air tube 14*c* is coupled with four voice chambers 12 and four earpieces 16 which permit four users to have a four-way conversation underwater, with all users being able to speak and hear all others at the same time. In one implementation, a float 15 (e.g., in the form of a hollow rigid lightweight sphere) may be attached to a center of the air tube 14*c* to prevent water from "puddling" in the center of the air tube 14*c* and maintain a clear airspace between each of the users.

Each of the voice chambers 12 may include a purge valve assembly, (e.g., one of the purge valve assemblies 30, 30*a* described above) in some embodiments of the underwater voice communication device which include more than one voice chambers 12 for use by plural speakers. In addition, the voice chambers 12 are held during use such that the respective purge assemblies are facing approximately downward in one embodiment and the positions of the users relative to one another is not critical and the users may be at different elevations within the water column. For four users to use the device 10*d*, all should begin purging at the same time to quickly clear the device 10, and the entire device 10 is purged regardless of the position of the divers.

As mentioned above, a single air tube may be connected with two voice chambers and two earpieces (configured similarly to the embodiment of FIG. 15 but for two people instead of four) to provide two-way communications between two people. Additional embodiments of device including a single air tube in fluid communication with voice chambers and earpieces may be designed to accommodate different numbers of users for one or two-way conversations.

Various clips and attachments (not shown) may be connected to the device 10 to allow the device 10 to be externally attached to the user (e.g., attached to the bathing suit, diving suit or other dive equipment) when not in use. In one embodiment, a shell-type cover may be fitted over the earpiece 16 with mating connections on the voice chamber 12 (inside or out). This can serve to protect the earpiece 16 and also function to be an easy on, easy off way to store the device on a user's dive suit when not in use. Various snaps or methods of removable connectors may be used. For example, Velcro, flexible button and mating undersized hole, button and keyhole shaped mating hole, snap hook and ring, are a few of the possible connectors.

The underwater voice communication devices described above may be used in other ways apart from providing an airspace from the mouth of the speaker to the ear of the listener as described above. For example, the underwater voice communication device may be used without having the earpiece 16 pressed against the listener's ear in a "transmit sound thru the water" method. To use in this method, the speaker may block the air chamber of ear seal 17 by covering aperture 21 with their finger, pressing the ear seal 17 against the side of the voice chamber 12, collapsing (kinking) and holding the air tube 14, or the earpiece 16 may be simply held below the level of the purge valve assembly while the speaker speaks into the voice chamber 12. Another way to use the underwater voice communication device in this manner is to entirely remove the air tube 14 and ear piece 16 and block the air passage where the air tube 14 is connected to the voice chamber 12 while speaking into the voice chamber 12.

These example methods of use operate to broadcast the speech directly into the water and which may be audible to users in the vicinity with a lower quality fidelity compared with the use of the underwater voice communication devices as described above where the earpiece 16 is sealed to the listener. The speech may be audible to listeners which are a relatively long distance (e.g., 20 feet or more) from the speaker. The device may be used in these methods when speaking short phrases, when the communication is an expected answer, for certain (lower pitched) voices or for an advanced pair of divers used to communicating underwater.

In other examples of use, voice communications of the device 10 may be recorded using a recording device, such as an audio recorder or underwater camera (for example contained in a waterproof housing and able to withstand pressures of normal scuba diving depths). For recording devices of sufficient size, the earpiece 16 may be pressed against a flat housing of the recording device and the voice sound waves within the device 10 cause vibrations of the housing which correspond to the speech of the speaker and may be recorded.

Figure 16:
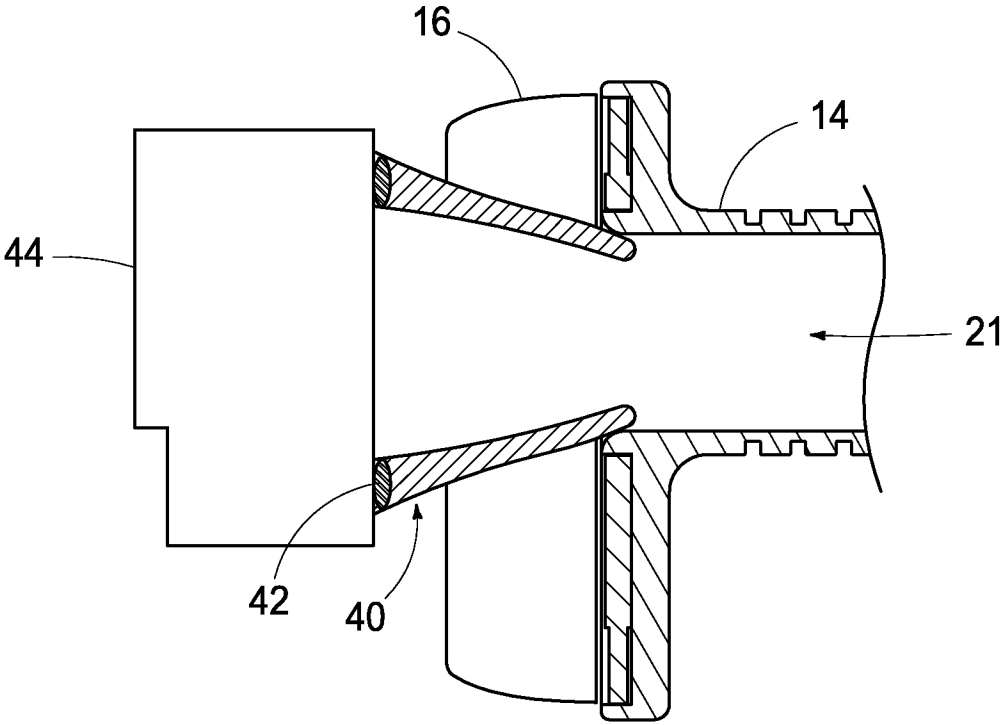
FIG. 16 is a cross-sectional view of an adapter of an underwater voice communication device according to one embodiment.

Referring to FIG. 16, an embodiment is shown where the underwater voice communication device 10 includes a removable recording device adapter 40 for use to communicate the voice sound waves to recording devices 44 of reduced size. The removable adapter 40 is used to couple the internal airspace of the device 10 to a waterproof housing of the recording device 44, such as an underwater camera, in the illustrated embodiment.

In one embodiment, adapter 40 is in the form of a rigid cone and one end of the adapter 40 is inserted into earpiece 16 to form at least a substantially watertight seal with the earpiece 16 and/or air tube 14 (adapter 40 forms the at least substantially watertight seal with a portion of air tube 14 about the aperture 21 of earpiece 16 in the illustrated embodiment). The other end of adapter 40 includes a soft rubber member 42 (e.g., such as an o-ring) which forms at least a substantially watertight seal against the housing of the recording device 44 and the housing forms a wall of the internal airspace of the device 10 after the water within the device 10 is purged as discussed above. Voice sound waves of the speaker's speech impact the wall of the housing 44 and the user's voice may be recorded with adequate clarity while underwater.

Figure 18:
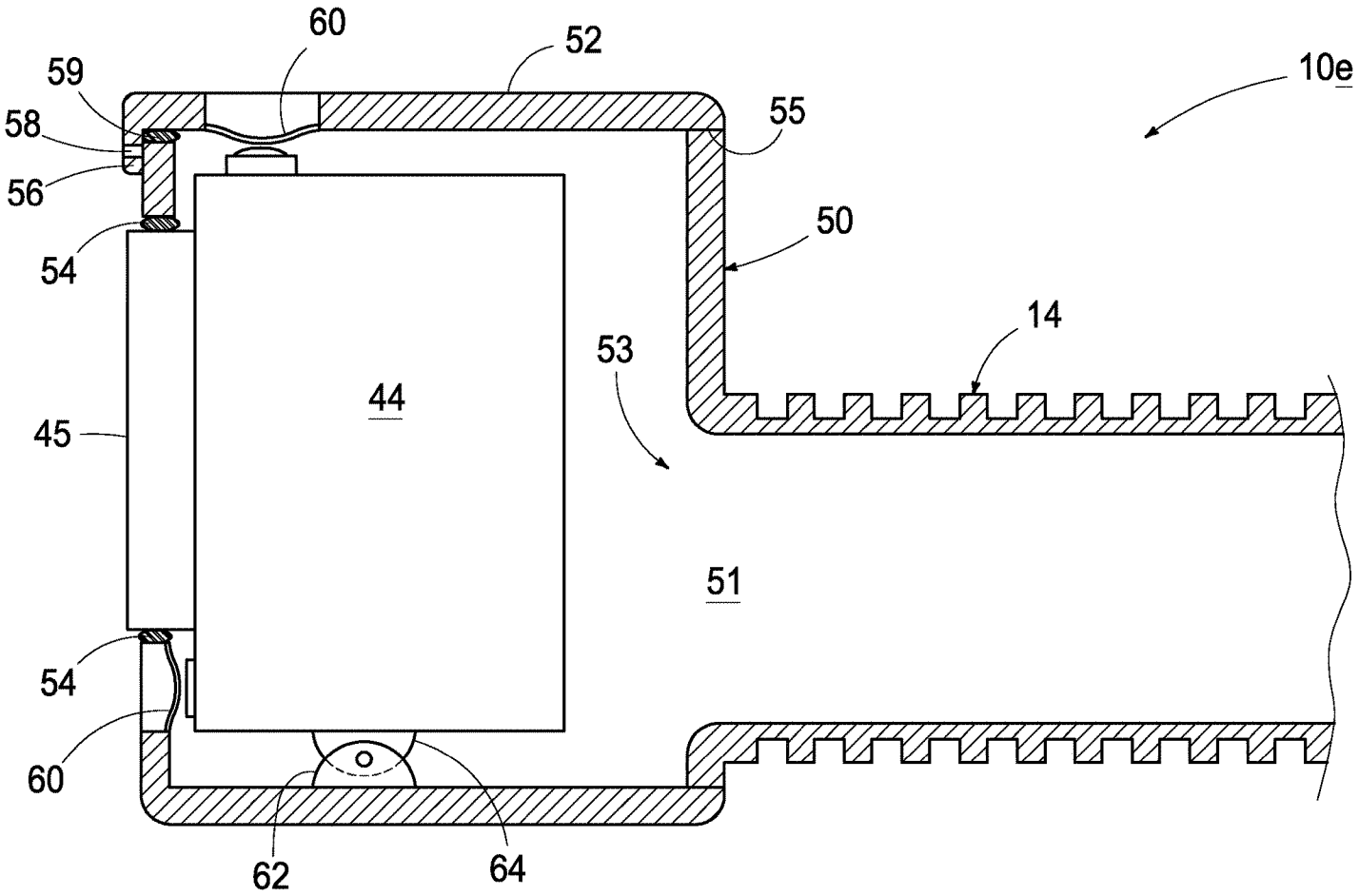
FIG. 18 is a cross-sectional view of an adapter of an underwater voice communication device according to one embodiment.

Referring to FIG. 18, another embodiment of the underwater voice communications device 10*e* is shown. In this embodiment, the earpiece and ear seal have been replaced by another recording device adapter which is the form of an enclosure 50 which encloses at least a portion of the recording device 44 in a sealed arrangement with respect to the internal volume 51 of the device 10. The enclosure 50 includes an aperture 53 which is open to air tube 14 in the depicted embodiment. This arrangement allows a user to speak to the recording device 44, or narrate a video in real time underwater and which may be recorded by the recording device 44. The enclosure 50 may be rigid, such as plastic, or semi-flexible, such as Shore A 70 silicone rubber, in example embodiments.

In one embodiment, the enclosure 50 designed for use with a recording device 44 in the form of a camera includes an opening that allows the lens 45 to contact water and has a watertight seal 54, such as an o-ring, surrounding the lens 45 and which allows the majority of the housing of the recording device 44 to be exposed to air inside the interval volume 51 of device 10. The upper surface 52 of the enclosure 50 may be attached to a remainder of the enclosure 50 via a hinge edge 55 which allows the upper surface 52 to be opened for insertion of the recording device 44 into the enclosure 50. A tab 56 and pin 58 may be used to seal the upper surface 52 to the remainder of the enclosure 50 once the recording device 44 is placed within enclosure 50 for use. A watertight seal 59 is included between the upper surface 52 and the remainder of the enclosure 50 in the illustrated configuration. In addition, one or more thin, flexible walls 60 may be included to allow the user to manipulate controls (e.g., pushbuttons) of the recording device 44 during use of device 44 within the interior of the enclosure 50. In addition, the lower surface of enclosure 50 may include a suitable mount 62 to receive and secure with a mount 64 of recording device 44.

Water within the internal volume 51 of the underwater voice communication device 10 and enclosure 50 exits the device 10 via the purge holes 18 as previously described. In this embodiment, voice sound waves are transmitted through the airspace within the volume 51 of the device 10 from the voice chamber 12, thru the air tube 14 to the enclosure 50 and thru the exterior, waterproof housing of the recording device 44 which records the speech. In some embodiments, the enclosure 50 does not provide any protection of the recording device 44 from water as the device 10 is typically flooded when not in use.

In another embodiment of the underwater voice communication device, the earpiece 16 remains connected to the air tube 14 and the enclosure 50 is constructed so that it attaches to the earpiece 16 as optional equipment (indirectly connected to the air tube 14 through the earpiece 16). In one arrangement, the enclosure 50 may include a hollow adapter, similar to the one shown in FIG. 16, to provide a sealed coupling of aperture 53 of enclosure 50 to aperture 21 of ear piece 16.

Figure 19:
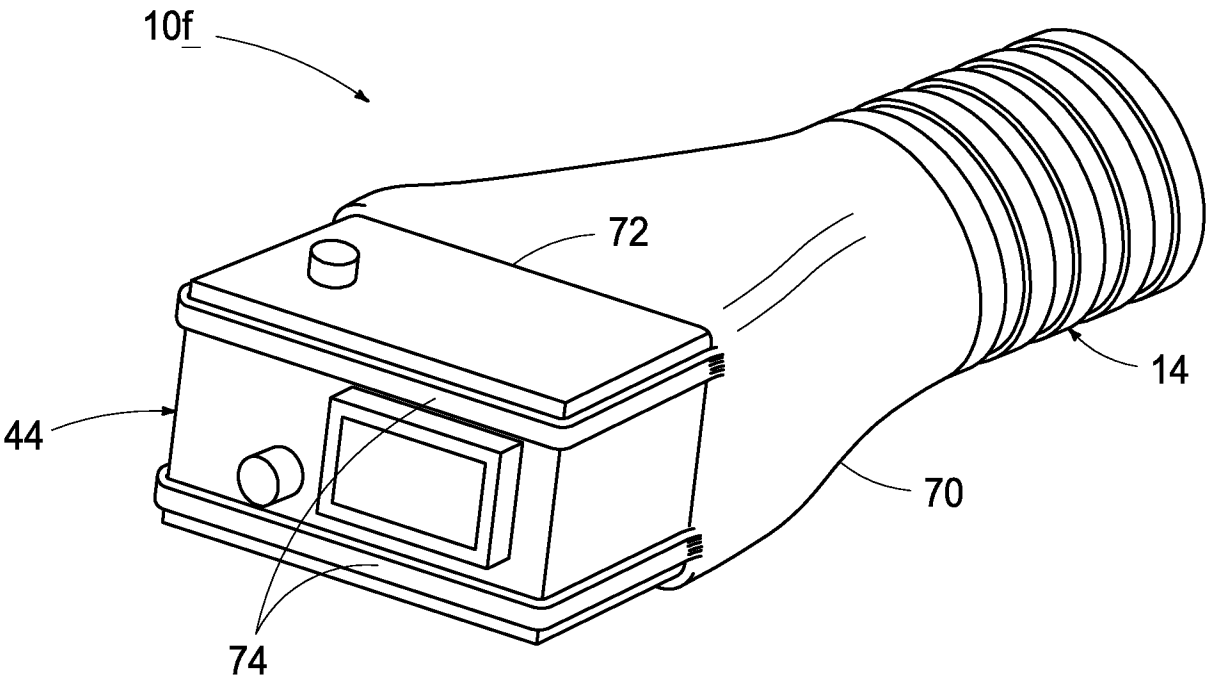
FIG. 19 is an isometric view of an adapter of an underwater voice communication device according to one embodiment.

Referring to FIG. 19, another embodiment of underwater voice communication device 10*f* is shown where the earpiece and ear seal have been replaced by a recording device adapter 70 which does not entirely enclose the recording device 44, but forms at least a substantially watertight seal with respect to a portion of the housing of the recording device 44. The adapter 70 may be removable from the air tube 14, or made part of or be permanently bonded to air tube 14 in possible embodiments.

In the illustrated embodiment, a plurality of rubber brackets or straps 74 are used to attach the housing of the recording device 44 to the adapter 70 so that the recording device 44 can remain attached to the device 10*f* through an entire dive, but can be easily detached. An o-ring 72 or other sealing member may be used to provide a watertight seal at the interface of the adapter 70 and the housing of the recording device 44. The internal volume 51 contacts at least a portion of the housing of the recording device 44 and voice sound waves within the airspace of the internal volume 51 impact the portion of the housing of the recording device 44 and are recorded.

When using the device 10 with a recording device 44, the clarity of the voice in the recording may be enhanced by using software to remove audio frequencies below about 300 Hertz from the recording. Software is readily available to easily post process the audio recordings, including for example, iMovie for Mac computers and Mp3-Editor for Windows-based computers. In addition, the voice chamber may include a bubble silencer when device 10 is to be used with a recording device 44 to reduce the presence of large bubbles which may otherwise interfere with the audio.

At least some embodiments of the underwater voice communication device are designed to be compact as practical for easy, out of the way storage. In one embodiment, the outer cylindrical surface of the voice chamber 12 may include a helical groove (not shown) which is sized to accept the air tube 14 and which facilitates spirally wrapping and storage of the air tube 14 about the voice chamber 12.

In some embodiments, a portion of air tube 14 may be stored within the voice chamber 12 when the underwater voice communication device is not in use. For example, referring to FIG. 17, the air tube 14 may be partially wrapped around the voice chamber 12 and a portion of the air tube 14 may be stored within the internal volume 13 of the voice chamber 12 with the earpiece 16 received at least partially within the face seal 17 of the voice chamber 12 for compact storage.

In one embodiment, the inside surfaces of the voice chamber 12 may be constructed with grooves (not shown) that mate to the corrugated surface of air tube 14 and which will allow the air tube 14 to be partially wrapped around the voice chamber 12 and a portion of air tube 14 stored inside the voice chamber 12. The grooves inside the internal surfaces of voice chamber 12 mate with the grooves in the air tube 14 and removably lock a portion of the air tube 14 to the interior of the voice chamber 12 and which will provide secure, compact storage when transporting the device in this described embodiment.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended aspects appropriately interpreted in accordance with the doctrine of equivalents.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. An underwater voice communication device comprising:

a voice chamber comprising a face seal which is configured to form at least a substantially watertight seal with respect to a mouth of a first user, wherein the voice chamber comprises an internal volume;

an earpiece comprising an ear seal which is configured to form at least a substantially watertight seal with respect to an ear of a second user, wherein the earpiece comprises an internal volume which is in fluid communication with the internal volume of the voice chamber;

wherein the internal volumes of the voice chamber and earpiece communicate voice sound waves from the mouth of the first user to the ear of the second user; and wherein the internal volumes of the voice chamber and earpiece communicate the voice sound waves from the mouth of the first user to the ear of the second user when the first and second users are submerged in water.

2. An underwater voice communication device comprising:

a voice chamber comprising a face seal which is configured to form at least a substantially watertight seal with respect to a mouth of a first user, wherein the voice chamber comprises an internal volume;

an earpiece comprising an ear seal which is configured to form at least a substantially watertight seal with respect to an ear of a second user, wherein the earpiece comprises an internal volume which is in fluid communication with the internal volume of the voice chamber;

wherein the internal volumes of the voice chamber and earpiece communicate voice sound waves from the mouth of the first user to the ear of the second user; and wherein the voice chamber comprises at least one purge hole which is in fluid communication with the internal volume of the voice chamber and the exterior of the underwater voice communication device.

3. The device of claim 2 wherein the underwater voice communication device is held in a predefined position during communication of the voice sound waves wherein the at least one purge hole is located at a lowest point of the underwater voice communication device.

4. The device of claim 2 wherein the underwater voice communication device is held in a predefined position during communication of the voice sound waves and the at least one purge hole is located in a lower surface of the voice chamber, and the voice chamber further comprises an indent which is configured to drain water from an air passage between the voice chamber and the ear piece to the at least one purge hole while the underwater voice communication device is held in the predefined position.

5. The device of claim 2 wherein the voice chamber comprises a one-way valve purge valve assembly which is configured to allow fluids to pass via the at least one purge hole from the internal volume of the voice chamber to the exterior of the underwater voice communication device.

6. The device of claim 1 further comprising an air tube intermediate the voice chamber and the earpiece, wherein the air tube comprises an internal volume which is in fluid communication with the internal volumes of the voice chamber and the earpiece.

7. The device of claim 6 wherein the internal volumes of the voice chamber, the earpiece and the air tube provide an airspace during use which communicates the sound waves.

8. The device of claim 6 further comprising at least one of another voice chamber and another earpiece which is in fluid communication with the air tube.

9. The device of claim 1 wherein the face seal of the voice chamber is configured to form the at least substantially watertight seal about the entirety of the mouth of the first user.

10. The device of claim 1 wherein the ear seal of the earpiece is configured to form the at least substantially watertight seal about the entirety of the ear of the second user.

11. The device of claim 1 wherein the earpiece comprises a rigid member usable by the second user to press the ear seal against at least one of the head and ear of the second user and the ear seal comprises a conformable member configured to form the at least substantially watertight seal with respect to the ear of the second user.

12. An underwater voice communication device comprising:

a voice chamber comprising a face seal which is configured to form at least a substantially watertight seal with respect to a mouth of a first user, wherein the voice chamber comprises an internal volume;

an earpiece comprising an ear seal which is configured to form at least a substantially watertight seal with respect to an ear of a second user, wherein the earpiece comprises an internal volume which is in fluid communication with the internal volume of the voice chamber;

wherein the internal volumes of the voice chamber and earpiece communicate voice sound waves from the mouth of the first user to the ear of the second user; and wherein the underwater voice communication device is held in a predefined position during communication of the voice sound waves, and wherein an upper surface of the voice chamber comprises a bubble silencer which comprises a plurality of apertures configured to permit air within the internal volume of the voice chamber to exit to the exterior of the underwater voice communication device.

13. An underwater voice communication device comprising:

a voice chamber comprising a face seal which is configured to form at least a substantially watertight seal with respect to a mouth of a first user, wherein the voice chamber comprises an internal volume;

an earpiece comprising an ear seal which is configured to form at least a substantially watertight seal with respect to an ear of a second user, wherein the earpiece comprises an internal volume which is in fluid communication with the internal volume of the voice chamber;

wherein the internal volumes of the voice chamber and earpiece communicate voice sound waves from the mouth of the first user to the ear of the second user; and an adapter configured to form at least a substantially watertight seal with respect to the earpiece and wherein the adapter is configured to communicate the voice sound waves to a recording device.

14. An underwater voice communication device comprising:

a voice chamber comprising a face seal which is configured to form at least a substantially watertight seal with respect to a mouth of a first user, wherein the voice chamber comprises an internal volume;

a recording device adapter which is configured to form at least a substantially watertight seal with respect to a recording device which is configured to record voice sound waves, wherein the recording device adapter comprises an internal volume; and wherein the internal volumes of the voice chamber and recording device adapter communicate the voice sound waves from the mouth of the first user to the recording device.

15. The device of claim 14 wherein the recording device adapter comprises an enclosure which is configured to define the internal volume of the recording device adapter and to receive the recording device within the internal volume of the recording device adapter.

16. The device of claim 14 wherein the recording device adapter is configured to form the at least substantially watertight seal with a housing of the recording device.

17. The device of claim 14 wherein an upper surface of the voice chamber comprises a bubble silencer which comprises a plurality of apertures configured to permit air within the internal volume of the voice chamber to exit to the exterior of the underwater voice communication device.

18. The device of claim 14 further comprising an air tube intermediate the voice chamber and the recording device adapter, wherein the air tube comprises an internal volume which is in fluid communication with the internal volumes of the voice chamber and the recording device adapter.

19. An underwater voice communication device comprising:

a voice chamber comprising a face seal which is configured to form at least a substantially watertight seal with respect to a mouth of a first user, wherein the voice chamber comprises an internal volume;

an earpiece comprising an ear seal which is configured to form at least a substantially watertight seal with respect to an ear of a second user, wherein the earpiece comprises an internal volume;

an air tube intermediate the voice chamber and the earpiece, wherein air tube comprises an internal volume which is in fluid communication with the internal volumes of the voice chamber and the earpiece;

wherein the internal volumes of the voice chamber and earpiece define an airspace to communicate voice sound waves from the mouth of the first user to the ear of the second user;

wherein the earpiece comprises a rigid member usable by the second user to press the ear seal against at least one of the head and ear of the second user and the ear seal comprises a conformable member configured to form the at least substantially watertight seal with respect to the ear of the second user; and wherein the underwater voice communication device is held in a predefined position during communication of the voice sound waves wherein at least one purge hole is located in a lower surface of the voice chamber and an indent in the lower surface of the voice chamber drains water from the internal volumes of the earpiece, the air tube and the voice chamber to the at least one purge hole.

20. An underwater voice communications method comprising:

using an underwater voice communications device, forming at least a substantially watertight seal with respect to a mouth of a first user submerged within water;

using the underwater voice communications device, forming at least a substantially watertight seal with respect to an ear of a second user submerged within water; and using an internal volume of the underwater voice communications device, communicating voice sound waves from the mouth of the first user to the ear of the second user.

21. The method of claim 20 further comprising, with the underwater voice communications device at least substantially watertight sealed to the mouth of the first user and the ear of the second user, purging water from the internal volume of the underwater voice communications device to provide an airspace from the mouth of the first user to the ear of the second user.

22. The method of claim 21 further comprising positioning the first user below the second user during the purging.

23. The method of claim 21 further comprising providing the underwater voice communication device in a predefined position during the purging wherein at least one purge hole is located in a lower surface of the voice chamber to permit water within the internal volume of the underwater voice communication device to drain externally of the underwater voice communication device.

24. The method of claim 20 wherein the communicating comprises communicating the voice sound waves using an air tube between the voice chamber and the earpiece of the underwater voice communication device.

25. The method of claim 24 wherein the air tube is flexible, and further comprising providing the air tube in a position to drain water from the earpiece and the air tube to the voice chamber during purging of the underwater voice communication device.

26. The device of claim 1 wherein the internal volumes of the voice chamber and earpiece are configured to provide an air space from the mouth of the first user to the ear of the second user during the communication of the voice sound waves from the mouth of the first user to the ear of the second user.

27. The device of claim 1 wherein the earpiece is configured to pass the voice sound waves from the internal volume of the voice chamber to the ear of the second user.

28. The method of claim 20 wherein the first and second users are submerged in water during the communicating, and further comprising, using the underwater voice communications device, providing an air space from the mouth of the first user to the ear of the second user during the communicating.

* * * * *